US010888971B2

(12) United States Patent
Butler et al.

(10) Patent No.: US 10,888,971 B2
(45) **Date of Patent: *Jan. 12, 2021**

(54) APPARATUS, SYSTEM, AND METHOD FOR MACHINING AN INNER DIAMETER OF BORED STRUCTURES USING AN ABRASIVE JET

(71) Applicant: Ormond, LLC, Auburn, WA (US)

(72) Inventors: Thomas J. Butler, Enumclaw, WA (US); Daniel G. Alberts, Maple Valley, WA (US); Chris Ager, Seattle, WA (US); Nicholas Cooksey, Seattle, WA (US)

(73) Assignee: ORMOND, LLC, Auburn, WA (US)

( * ) Notice: Subject to any disclaimer, the term of this patent is extended or adjusted under 35 U.S.C. 154(b) by 398 days.

This patent is subject to a terminal disclaimer.

(21) Appl. No.: 15/987,639

(22) Filed: May 23, 2018

(65) Prior Publication Data

US 2018/0264624 A1 Sep. 20, 2018

Related U.S. Application Data

(63) Continuation of application No. 14/693,774, filed on Apr. 22, 2015, now Pat. No. 9,987,725.

(60) Provisional application No. 61/982,783, filed on Apr. 22, 2014.

(51) Int. Cl.

| | |
|---|---|
| ***B24C 3/32*** | (2006.01) |
| ***B24C 1/04*** | (2006.01) |
| ***B24C 7/00*** | (2006.01) |

(52) U.S. Cl.
CPC ..... *B24C 3/325* (2013.01); *B24C 1/045* (2013.01); *B24C 7/0007* (2013.01); *B24C 7/0015* (2013.01)

(58) Field of Classification Search
CPC ..... B24C 1/04; B24C 1/045; B24C 7/0007
See application file for complete search history.

(56) References Cited

U.S. PATENT DOCUMENTS

| | | | | |
|---|---|---|---|---|
| 9,987,725 | B1 * | 6/2018 | Butler | B24C 1/045 |
| 2004/0121703 | A1 * | 6/2004 | Herber | B24C 7/0053 451/2 |
| 2008/0142050 | A1 * | 6/2008 | Hashish | B24C 3/325 134/22.12 |
| 2009/0233531 | A1 * | 9/2009 | Kuroiwa | B24C 7/0046 451/66 |
| 2013/0122791 | A1 * | 5/2013 | Hashish | B24C 3/325 451/446 |

* cited by examiner

*Primary Examiner* — George B Nguyen
(74) *Attorney, Agent, or Firm* — Davis Wright Tremaine LLP; George C. Rondeau, Jr.

(57) ABSTRACT

An abrasive jet apparatus configured to machine features into an inner diameter of bored structures. In the abrasive jet apparatus, an abrasive mixture of pressurized liquid and abrasive particles is propelled as an abrasive jet in a direction other than the direction in which the abrasive jet apparatus extends. The abrasive jet apparatus may be implemented in an automated boring system and boring method for machining rifling grooves and other features into bored structures. The boring system and boring method use an iterative process of mapping a target surface of the bored structure and adjusting parameters of the boring system in between successive passes of the abrasive jet on the target surface.

12 Claims, 18 Drawing Sheets

APPARATUS, SYSTEM, AND METHOD FOR MACHINING AN INNER DIAMETER OF BORED STRUCTURES USING AN ABRASIVE JET

CROSS REFERENCE

This application is a continuation of U.S. patent application Ser. No. 14/693,774, filed Apr. 22, 2015, which claims priority to provisional U.S. Patent Application No. 61/982,783, filed Apr. 22, 2014, the entirety of which is incorporated herein by reference.

TECHNICAL FIELD

This invention relates to machining rifling features into bored structures such as gun barrels using an apparatus that directs an abrasive jet comprising a liquid and abrasive particle mixture. This invention also relates to changing bore diameters of bored structures such as gun barrels using the abrasive jet apparatus. This invention also relates to systems and methods of machining features into, or changing bore diameters of, bored structures.

BACKGROUND

Gun barrels are subjected to very high internal pressures and temperatures as propellant in a combustion chamber ignites and generates hot gas to provide propulsive force to a projectile. Higher temperature propellants have been developed to propel projectiles at a higher velocity from the gun barrel. Unfortunately, the higher temperatures and pressures in the gun barrels can also erode the bore surface of the gun barrel over time. In the past, an electroplated chrome finish was typically applied to gun barrels to protect the gun barrels against the increased temperatures and pressures. Over time, increasing muzzle velocity and range requirements have led to higher-temperature propellant formulations. Even electroplated gun barrels cannot weather these modern higher-temperature propellant formulations, leading to severe barrel life reductions and poor weapon performance.

In response, alternative coatings to electroplated chrome were developed to withstand the higher-temperature propellant and meet certain requirements, including the ability to withstand a higher melting point than chrome (1875° C.) and having a Young's Modulus comparable to the base material, steel. These requirements limit consideration to a few refractory metals, such as rhenium, niobium, tantalum, tungsten and molybdenum, by way of non-limiting example. Silicon nitride and other ceramic liners have similar traits and may also be considered for future weapon systems.

A major limitation with refractory metal and ceramic liners is the difficulty in machining rifling grooves. For a medium caliber weapon, typical rifling groove dimensions would be 0.5 mm+/−0.1 mm deep by 2.35 mm wide with a progressive 1 in 8 twist. These grooves may be mechanically machined, electrochemically milled, rotary forged or button rifled. In refractory metals however, machining the rifling grooves has proved difficult. Barrels lined with refractory metals may be manufactured by explosively bonding the refractory metal liner to the main barrel which can leave an uneven surface and liner that varies in thickness along the length of the barrel.

Previous attempts to machine rifling grooves in refractory metal and metal ceramic composite barrel liners have been largely unsuccessful. These attempts have used electron discharge machining (EDM), traditional machine tooling, forging, broaching, and electrochemical machining. Broaching, the traditional method used in conventional steel barrels, is extremely challenging to implement in refractory metals. Machining refractory metals with traditional machine tools typically causes rapid tool wear due to the strength and temperature resistance of the refractory metals and leaves a poor surface finish thereon. Electron discharge machining (EDM) is very slow and leaves a recast layer which negatively affects the life of the barrel. Electrochemical machining has been unsuccessful on refractory metals of interest such as tantalum and has been unsuccessful in machining some ceramic-metallic composites. Previous attempts to waterjet mill gun barrels by pointing the jet at a shallow angle to the target surface have generally led to poor depth control, rough surfaces and very slow material removal rates. Waterjet machining nozzles are typically 1" or more in diameter and 10" or more in length and have to be operated at right angles to the machined surface. Obviously, these nozzles and the associated operating parameters cannot be used inside small bores that are typical for small and medium caliber gun barrels.

A reliable and inexpensive method of machining the bores of refractory metal and ceramic lined barrels is needed. In addition to machining rifling grooves, a method of machining the surface of the barrel to open the diameter to a consistent dimension is also needed. Additionally, current methods do not allow the use of advanced gun barrel designs with varying rifling twist pitch angles.

BRIEF DESCRIPTION OF THE DRAWINGS

Exemplary embodiments are illustrated in the referenced figures. The embodiments and figures disclosed herein are intended to be illustrative rather than restrictive.

DETAILED DESCRIPTION

Figure 1:
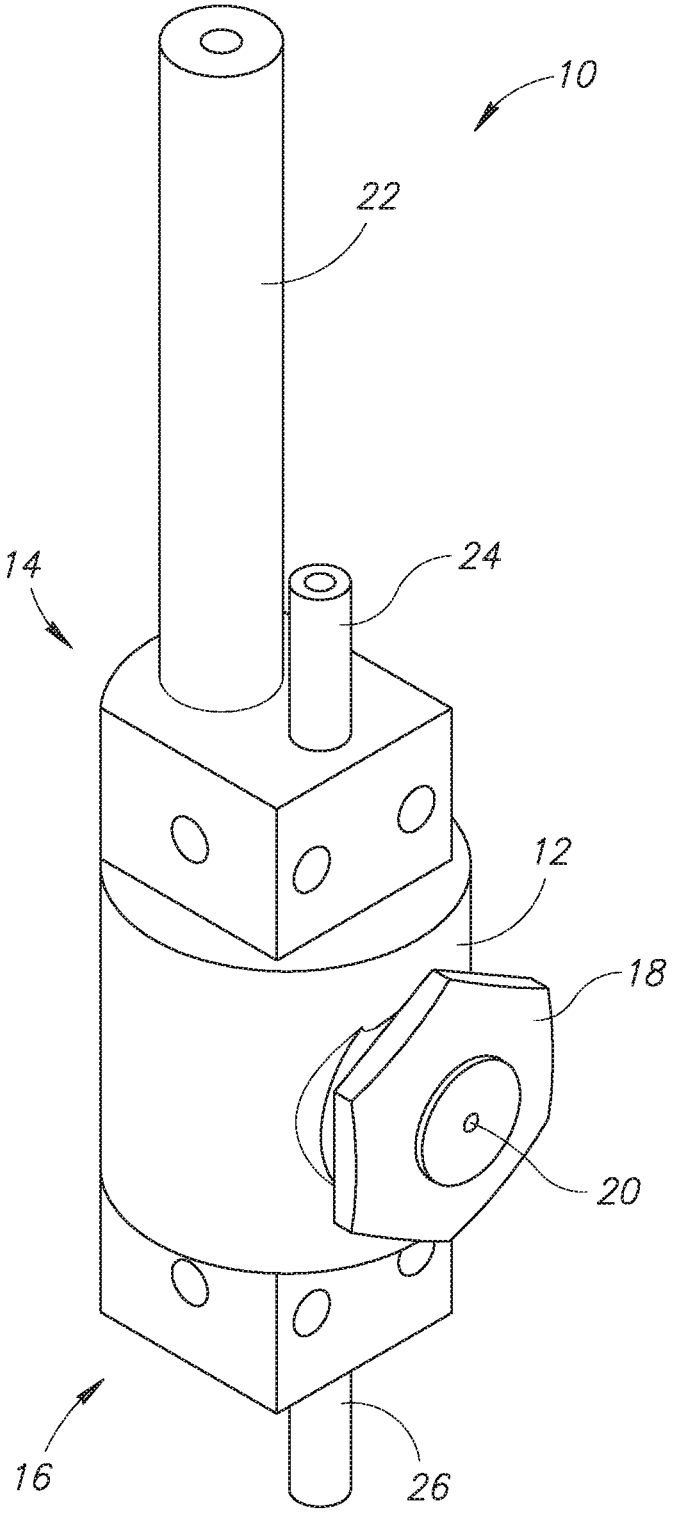
FIG. 1 illustrates a top perspective view of an abrasive jet apparatus according to a first embodiment.
Figure 2:
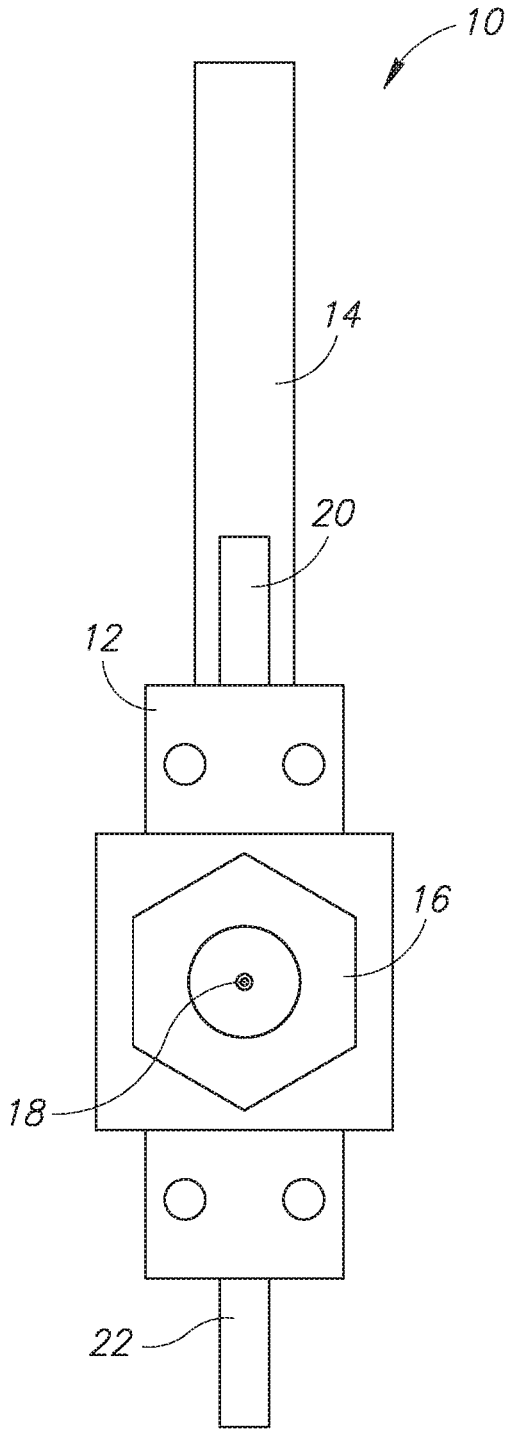
FIG. 2 illustrates a front side view of the abrasive jet apparatus of FIG. 1.
Figure 3:
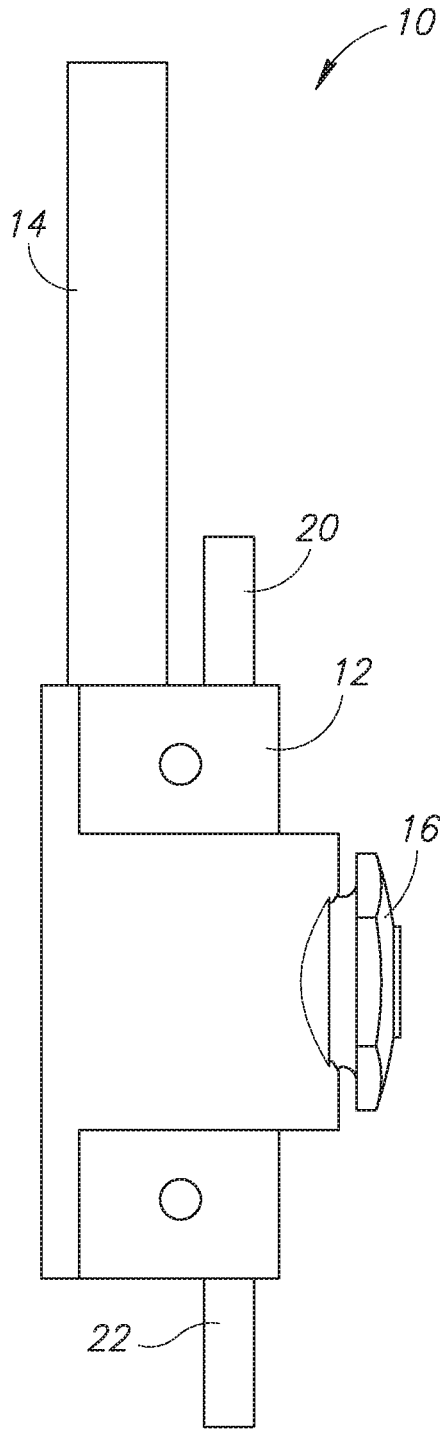
FIG. 3 illustrates a left side view of the abrasive jet apparatus of FIG. 1.

An abrasive jet apparatus 10 is shown in FIGS. 1-5 according to a first embodiment. The abrasive jet apparatus 10 has an abrasive jet main body 12 with a body upper portion 14 and a body lower portion 16. The abrasive jet apparatus 10 also has a nozzle portion 18 with a nozzle conduit 20. A liquid inlet tube 22 and abrasive particle inlet tube 24 are connected to the body upper portion 14. An abrasive particle outlet 26 is connected to the body lower portion 16. The liquid inlet tube 22 may be a rigid boring bar comprised of metal.

Figure 4:
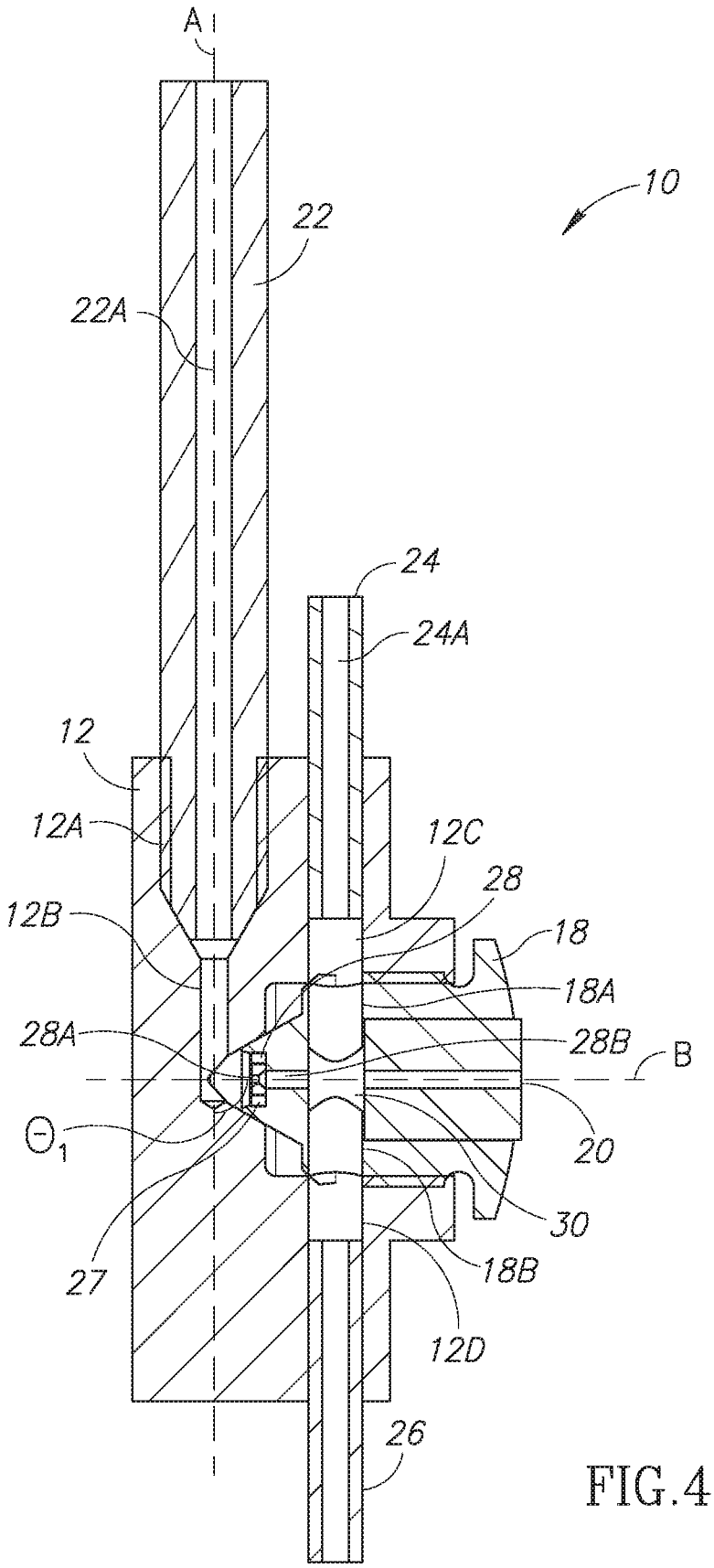
FIG. 4 illustrates a cross-sectional left side view of the abrasive jet apparatus of FIG. 3.

The liquid inlet tube 22 fits into and is fixed within a first cavity 12A of the abrasive jet main body 12, as shown in FIG. 4. A pressurized liquid is injected into a liquid tube inner conduit 22A. The pressurized liquid travels in a direction along axis A into a second cavity 12B of the abrasive jet main body 12. A seal 27 is disposed on a first end of the nozzle 20. The seal 27 envelops an orifice 28 through which a fluid may pass. The orifice 28 is centered along axis B. The seal 27 is composed of a material that is very hard on the Mohs scale, such as ruby, sapphire, or diamond. The orifice 28 has a cylindrical section 28A on a side closest to the second cavity 12B and a conical section 28B. The cylindrical section 28A has parallel walls extending in a direction parallel to axis B. The conical section 28B has a conical shape with walls diverging away from the cylindrical section 28A. The pressurized liquid passes through orifice 28 creating a high-velocity liquid jet that travels along axis B. The high-velocity liquid jet enters a mixing chamber 30 of the nozzle portion 18. The pressure of the liquid jet on the downstream side of the orifice 28 is lower than the pressure of the pressurized liquid on the upstream side of the orifice 28.

An abrasive particle inlet tube 24 extends into a third cavity 12C of the abrasive jet main body 12. The nozzle 18 has an abrasive particle inlet 18A forming a path from the third cavity 12C to the mixing chamber 30. Abrasive particles may be supplied to an inner conduit 24A of the abrasive particle inlet tube 24. Abrasive particles from the abrasive particle inlet tube 24 pass through the third cavity 12C and the abrasive particle inlet 18A and into the mixing chamber 30, where they are entrained by the high-velocity liquid jet from the orifice 28. Specifically, the Venturi effect draws abrasive particles into the mixing chamber 30 from the abrasive particle inlet 18A. The abrasive particles and liquid are mixed into an abrasive mixture in the mixing chamber 30. The abrasive particles in the abrasive mixture are accelerated through the nozzle conduit 20 to form an abrasive jet. The nozzle conduit 20 may be formed of a hard cermet mixing tube, by way of non-limiting example. The abrasive liquid jet is propelled from the nozzle conduit 20 along axis B. Axis B is formed at an angle $\theta_1$ to axis A. In the abrasive jet apparatus 10, the angle $\theta_1$ is a 90° angle.

The abrasive jet apparatus 10 uses is an extremely short nozzle portion 18 with a jet vector perpendicular to the axis of the target surface of the bored structure. This configuration is used to machine hard surfaces, such as ceramic materials, where the optimum angle of impact of the abrasives is normal to the surface. The nozzle conduit 20 typically has a 0.02 inch to 0.04 inch inner diameter bore. This configuration may be used to bore the diameter of a barrel to a larger size. This configuration may be used to machine a groove larger in width than the diameter of the nozzle conduit 20 by directing the abrasive jet along multiple partially overlapping paths over a target surface of a bored structure.

Although the abrasive jet is propelled at an angle $\theta_1$ of 90° in the first embodiment, the abrasive jet apparatus may instead be designed to propel the abrasive jet at any angle $\theta_1$ satisfying $0° < \theta_1$ 90°. In particular, the abrasive jet main body 18 and/or nozzle portion 20 may be oriented within the jet main body 12 to propel the abrasive jet at an angle between 0° and 90° with respect to a target surface of the bored structure.

The abrasive particle outlet 26 provides a uniform flow of abrasive particles into and away from the mixing chamber 30. The abrasive particle outlet 26 extends into a fourth cavity 12D of the abrasive jet main body 12. The nozzle 20 has an abrasive particle outlet 18B forming a path from the mixing chamber 30 to the fourth cavity 12D. Low or negative pressure may be applied to the abrasive particle outlet 26 to create a positive flow of abrasive particles from the mixing chamber 30 to the abrasive particle outlet 26. A vacuum or other similar device may be connected to the abrasive particle outlet 26 to create the low or negative pressure at the abrasive particle outlet 18B. Application of the low or negative pressure to the abrasive particle outlet 26 promotes a uniform introduction of abrasive particles into the high-velocity abrasive jet. The low or negative pressure may also improve the overall flow of the abrasive jet by removing excess abrasive particles and air from the mixing chamber 30.

Figure 5:
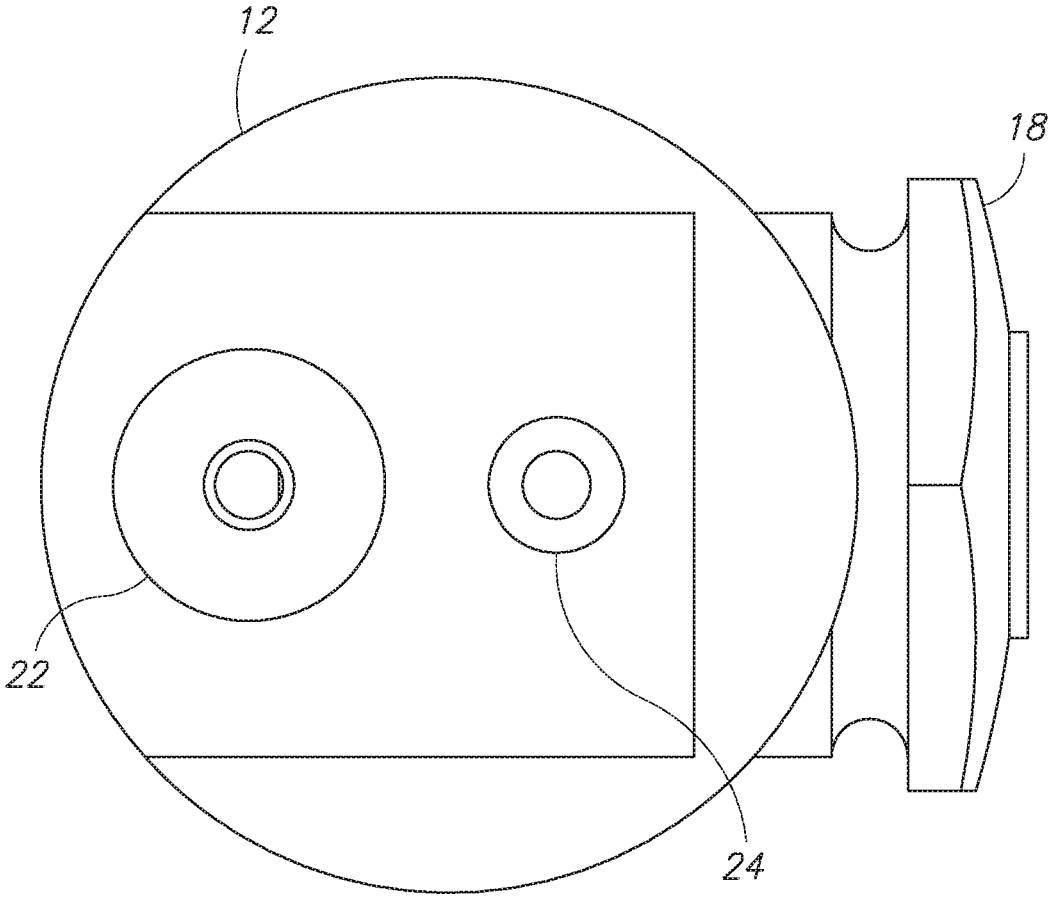
FIG. 5 illustrates an enlarged top view of the abrasive jet apparatus of FIG. 1.

The abrasive jet apparatus 10 has a small profile when viewed from above, as shown in FIG. 5. The abrasive jet apparatus 10 is sized to be inserted into a small, bored structure, such as a gun barrel. The abrasive jet apparatus 10 may fit into a bored structure having an inner diameter as small as 5 mm.

Figure 8:
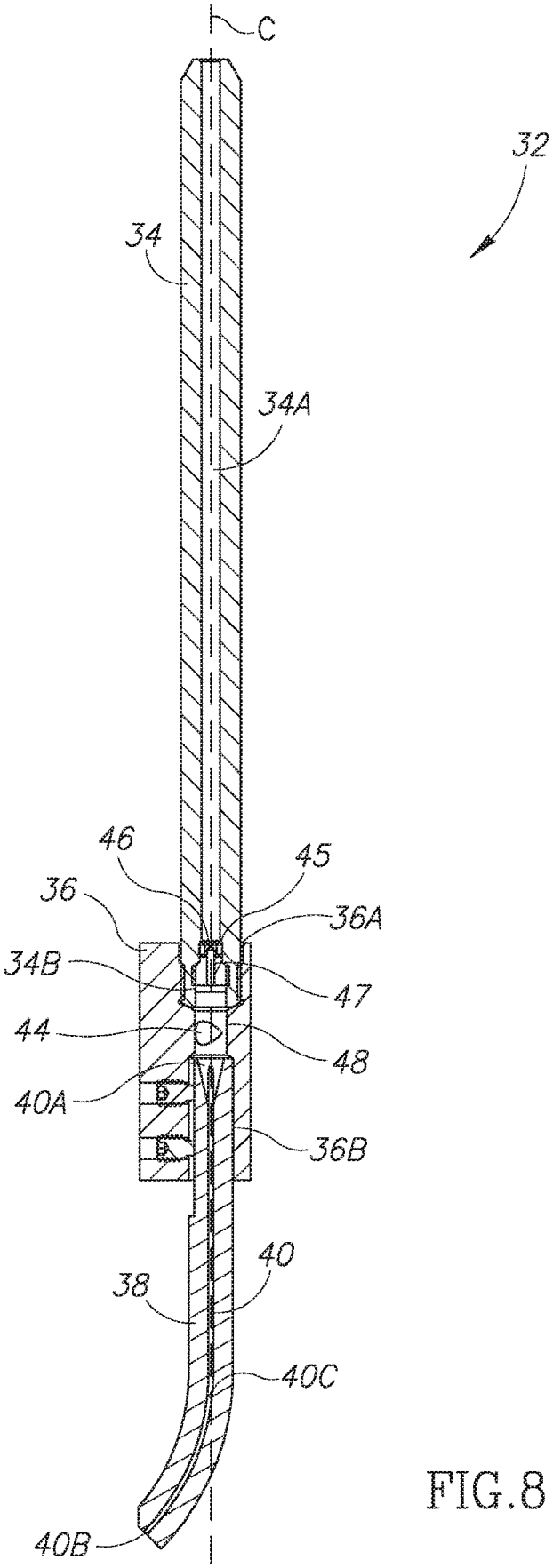
FIG. 8 illustrates a cross-sectional left side view of the abrasive jet apparatus of FIG. 7.
Figure 9:
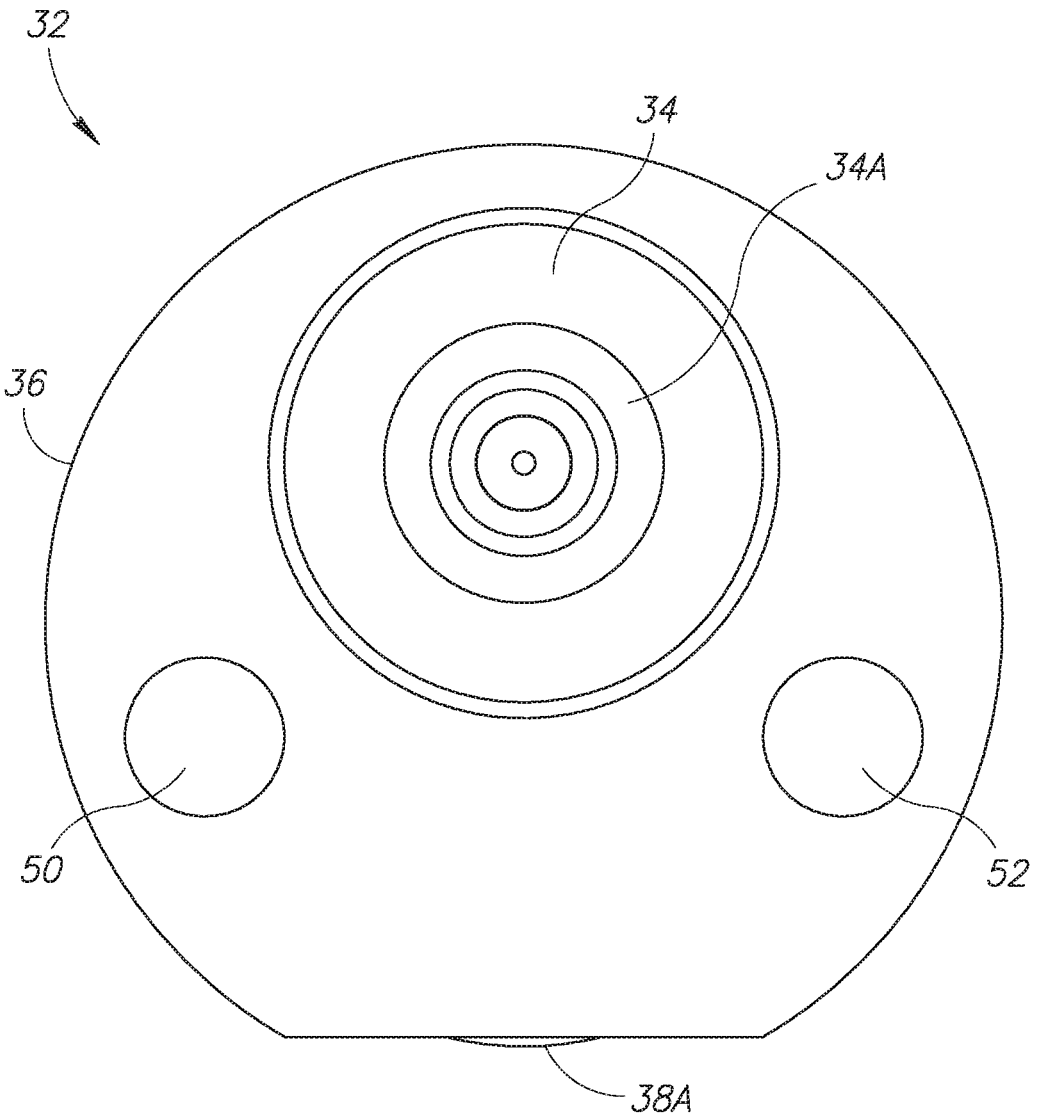
FIG. 9 illustrates an enlarged top view of the abrasive jet apparatus of FIG. 6.
Figure 10:
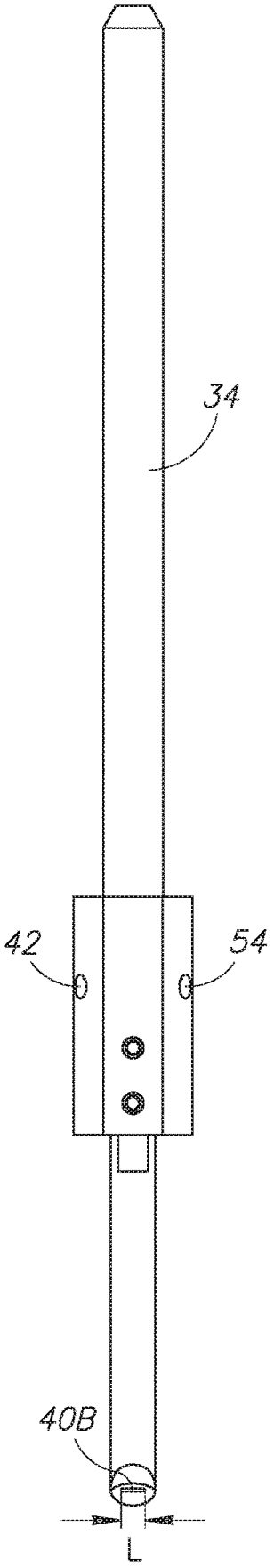
FIG. 10 illustrates a front side view of the abrasive jet apparatus of FIG. 6.
Figure 11:
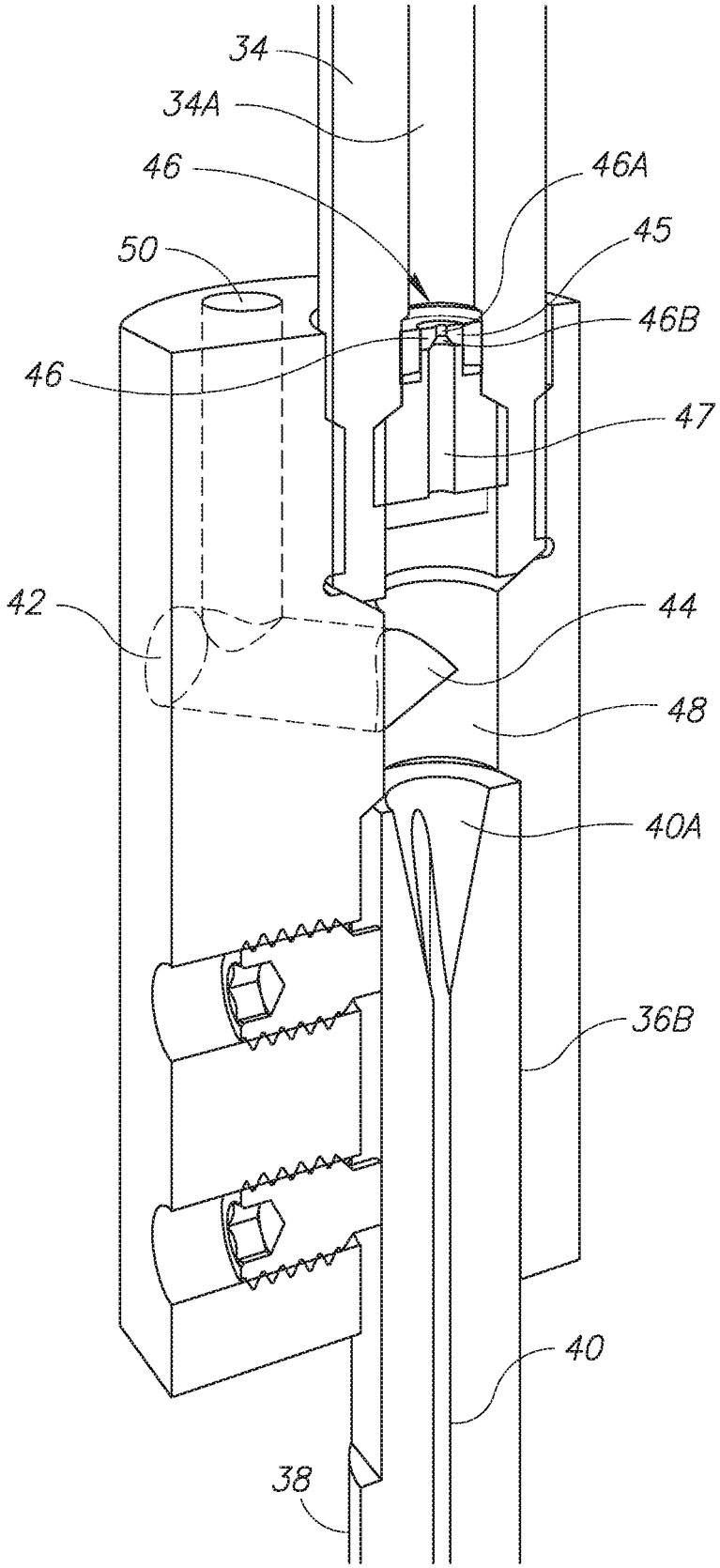
FIG. 11 illustrates a cross-sectional perspective right side view of an abrasive jet main body of the abrasive jet apparatus of FIG. 6.

An abrasive jet apparatus 32 is shown in FIGS. 6-12 according to a second embodiment. The abrasive jet apparatus 32 generally extends in a direction along axis C, as shown in FIG. 8. The abrasive jet apparatus 32 has a liquid inlet tube 34 connected to an upper portion of an abrasive jet main body 36. The liquid inlet tube 34 may be a rigid boring bar comprised of metal. A abrasive particle input port 50 is disposed on a top of the abrasive jet main body 36, as illustrated in FIGS. 9 and 11. A nozzle portion 38 extends from a lower portion of the abrasive jet main body 36. The nozzle portion 38 has a straight portion extending along the axis C. The nozzle portion 38 also has a bent portion bending away from the axis C. Alternatively, the nozzle portion 38 may be curved along its entire length. As shown in FIG. 8, a nozzle conduit 40 is located in the nozzle portion 38 and terminates at an end of the nozzle portion 38.

The liquid inlet tube 34 has an inner conduit portion 34A through which pressurized liquid may flow, as shown in FIG. 8. A bottom end of the liquid inlet tube 34 fits into and is fixed within a first cavity 36A on the abrasive jet main body 36. An orifice 46 is disposed between the inner conduit portion 34A and the mixing chamber 48. The seal 45 has an orifice 46 centered along axis C. The seal 45 and the orifice 46 are substantially identical to seal 27 and orifice 28 otherwise, so further description of the seal 45 and the orifice 46 is omitted for the sake of brevity. A pressurized liquid is injected into the inner conduit portion 34A and travels in a direction along axis C into a cylindrical upper section 46A of the orifice 46 and out of a conical lower section 46B, best seen in FIG. 11. The liquid is propelled through the orifice 46 and exits therefrom as a high-velocity liquid jet. The high-velocity liquid jet passes through an orifice conduit 47 into mixing chamber 48.

Abrasive particles are supplied to the abrasive particle input port 50, shown in FIGS. 9 and 11. Port 42 shown in FIGS. 6, 7, 10 and 11 is provided for machinability of abrasive port 44 and is plugged prior to operation. As seen in FIG. 11, an abrasive particle inlet 44 disposed on a sidewall of the mixing chamber 48 to which abrasive particles may be supplied from the abrasive particle input port 50. A port 42 is sealed (not shown), creating a sealed passageway from the abrasive particle input port 50 to the mixing chamber 48. Referring back to FIG. 8, the high-velocity liquid jet entrains abrasive particles from the abrasive particle inlet 44 into the mixing chamber 48. The abrasive particles are drawn from the abrasive particle inlet 44 into the mixing chamber 48 by the Venturi effect. In the mixing chamber 48, the abrasive particles and the liquid are mixed into a fluid/abrasive mixture. The abrasive particles in the abrasive mixture are accelerated in the nozzle conduit 40 to form an abrasive jet.

Figure 6:
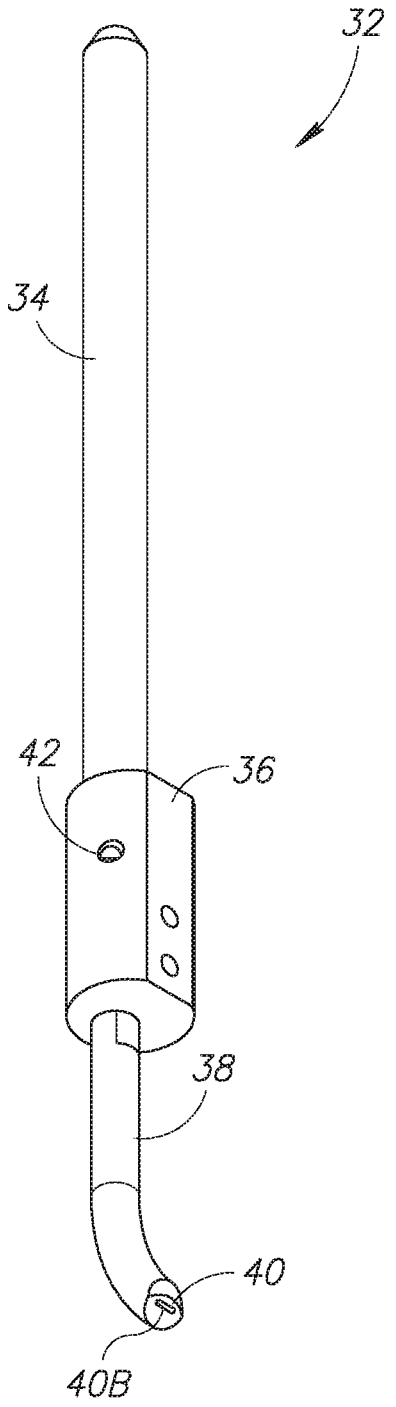
FIG. 6 illustrates a bottom perspective view of an abrasive jet apparatus according to a second embodiment.
Figure 7:
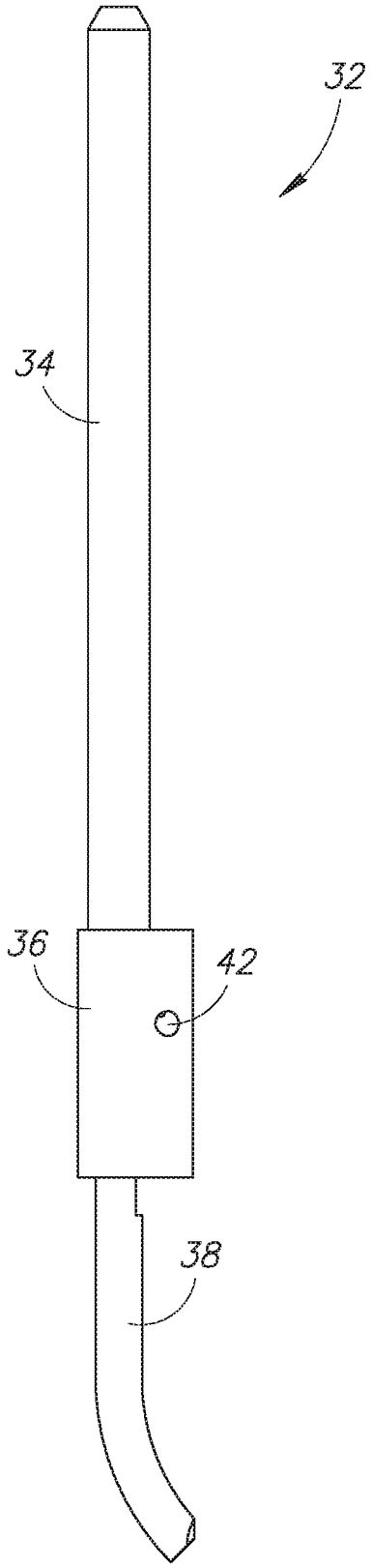
FIG. 7 illustrates a left side view of the abrasive jet apparatus of FIG. 6.
Figure 12:
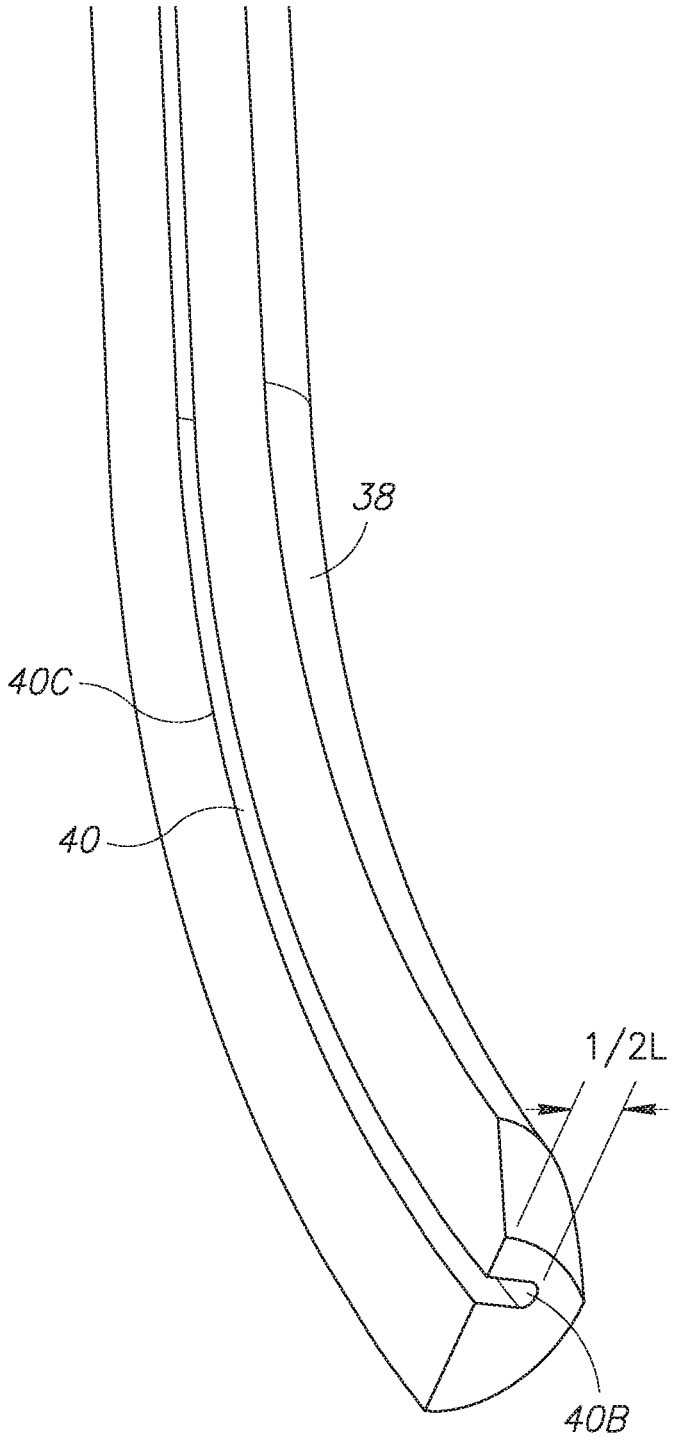
FIG. 12 illustrates a cross-sectional perspective left side view of a nozzle portion of the abrasive jet apparatus of FIG. 6.

In conventional waterjet machining, the orifice and nozzle portion are aligned to prevent the liquid jet from striking a wall of the nozzle portion. In contrast, the abrasive jet apparatus 32 has a bent or curved nozzle portion 38 so that the abrasive mixture will strike a curved wall portion 40C of the nozzle conduit 40. Further, the orifice 46 and nozzle conduit 40 are aligned so that the abrasive mixture will strike the wall portion 40C of the nozzle conduit 40 where the nozzle portion 38 bends or curves. When the abrasive particles strike the wall portion 40C, the abrasive particles spread in a length direction L of the nozzle conduit 40 (see FIG. 10). When the abrasive jet is propelled from a nozzle aperture 40B of the nozzle portion 40, the abrasive particles spread into a fan shape. The abrasive jet is propelled from the nozzle aperture 40B in a different direction than axis C. The fan shape of the abrasive jet allows careful control of the width and depth of a groove cut into a target surface of a bored structure by the abrasive jet. The groove cut into the target surface will have a width corresponding to the length L of the nozzle conduit 40 shown in FIGS. 11 and 12. The nozzle conduit 40 is machined to have an oblong slot shape, as seen in FIGS. 6, 10 and 12, using EDM by way of non-limiting example. The oblong slot shape promotes a uniform distribution of abrasives in the length direction L of the nozzle conduit 40. Although the nozzle conduit 40 shown in FIGS. 6, 10 and 12 has an oblong slot shape with rounded ends, the nozzle conduit 40C may instead have a round or rectangular shape. To channel the abrasive mixture from the mixing tube 48 into the nozzle conduit 40, the nozzle conduit 40 may have a conical portion 40A at a nozzle side of the mixing chamber 48, as seen in FIGS. 8 and 11.

The abrasive jet apparatus 32 has a small profile when viewed from above, as seen in FIG. 9. The abrasive jet main body 36 is sized to be inserted into a small bored structure, such as a gun barrel. The abrasive jet apparatus 32 may fit into a bored structure having an inner diameter as small as 5 mm. The nozzle portion 38 has a nozzle protrusion 38A that slightly protrudes from a side of the abrasive jet main body 36, as shown in FIG. 9. However, nozzle protrusion 38A may be removed via machining to further reduce the small profile of the abrasive jet main body 36.

The abrasive jet apparatus 32 may have an abrasive particle outlet (not shown) on a portion of the sidewalls of the mixing chamber 48. The abrasive particle outlet may be identical in size and shape to the abrasive particle inlet 44. The abrasive particle outlet may be directly opposite to the abrasive particle inlet 44 on the sidewall of the mixing chamber 48. The abrasive particle outlet is connected to an abrasive particle output port 52 illustrated in FIG. 9. Port 54 shown in FIG. 10 is provided for machinability of the abrasive particle outlet (not shown) on the sidewall of the mixing chamber 48 and is plugged prior to operation. The port 54 is sealed in a similar manner to port 42 (not shown), creating a sealed passageway from the mixing chamber 48 to the abrasive particle output port 52. The abrasive particle outlet and the abrasive particle output port 52 are located on the right side of the abrasive jet main body 34. The abrasive particle outlet and the abrasive particle output port 52 have the same structure as the abrasive particle inlet 44 and the abrasive particle input port 50, respectively. Low or negative pressure may be applied to the abrasive particle output port 52 in the same manner and to the same effect as described with reference to abrasive jet apparatus 10, so further description thereof is omitted.

Figure 13:
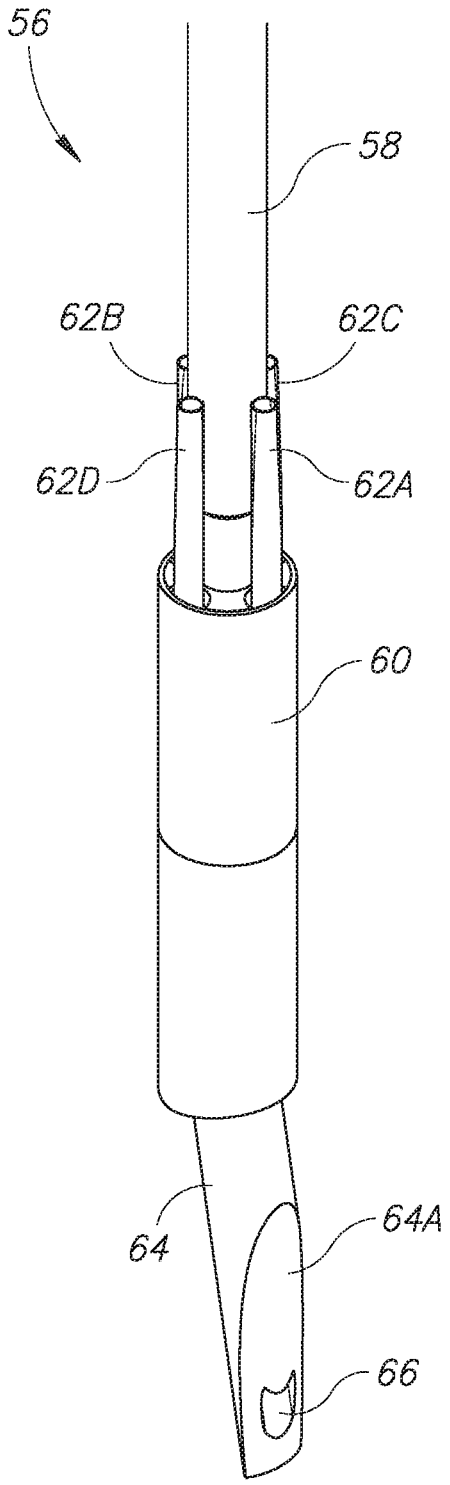
FIG. 13 illustrates a top perspective view of an abrasive jet apparatus according to a third embodiment.
Figure 14:
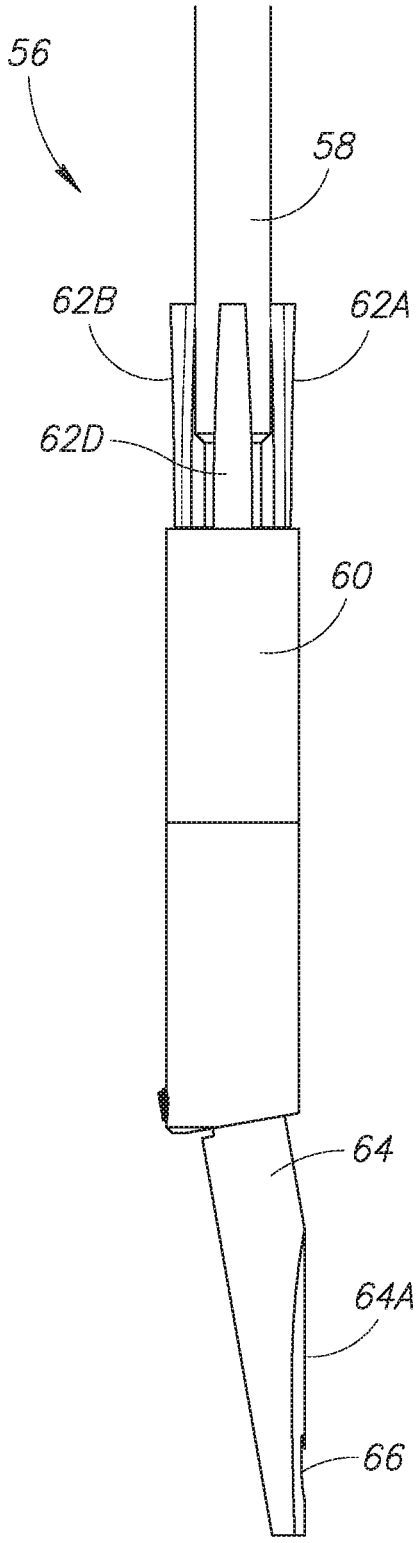
FIG. 14 illustrates a left side view of the abrasive jet apparatus of FIG. 13.

An abrasive jet apparatus 56 is shown in FIGS. 13 and 14 according to a third embodiment. The abrasive jet apparatus 56 generally extends along axis D, shown in FIG. 15. The abrasive jet apparatus 56 has an abrasive jet main body 60 that also extends along axis D. A liquid inlet tube 58 and several abrasive particle inlets/outlets 62A-62D extend into tube cavities 61A-61D of the abrasive jet main body 60, as shown in FIG. 16. The abrasive particle inlets/outlets 62A-62D are arranged around the liquid inlet tube 58. A nozzle portion 64 extends from a lower portion of the abrasive jet main body 60. As seen in FIGS. 13, 14, 16 and 17, the nozzle portion 64 may have a rounded portion 64A that is rounded to reduce the profile of the nozzle portion 64. A nozzle conduit 66 in the nozzle portion 64 terminates at an end of the nozzle portion 64. The small profile of the nozzle portion 64 and jet main body 60 allow the abrasive jet apparatus 56 to fit into a bored structure having an inner diameter as small as 5 mm.

Figure 15:
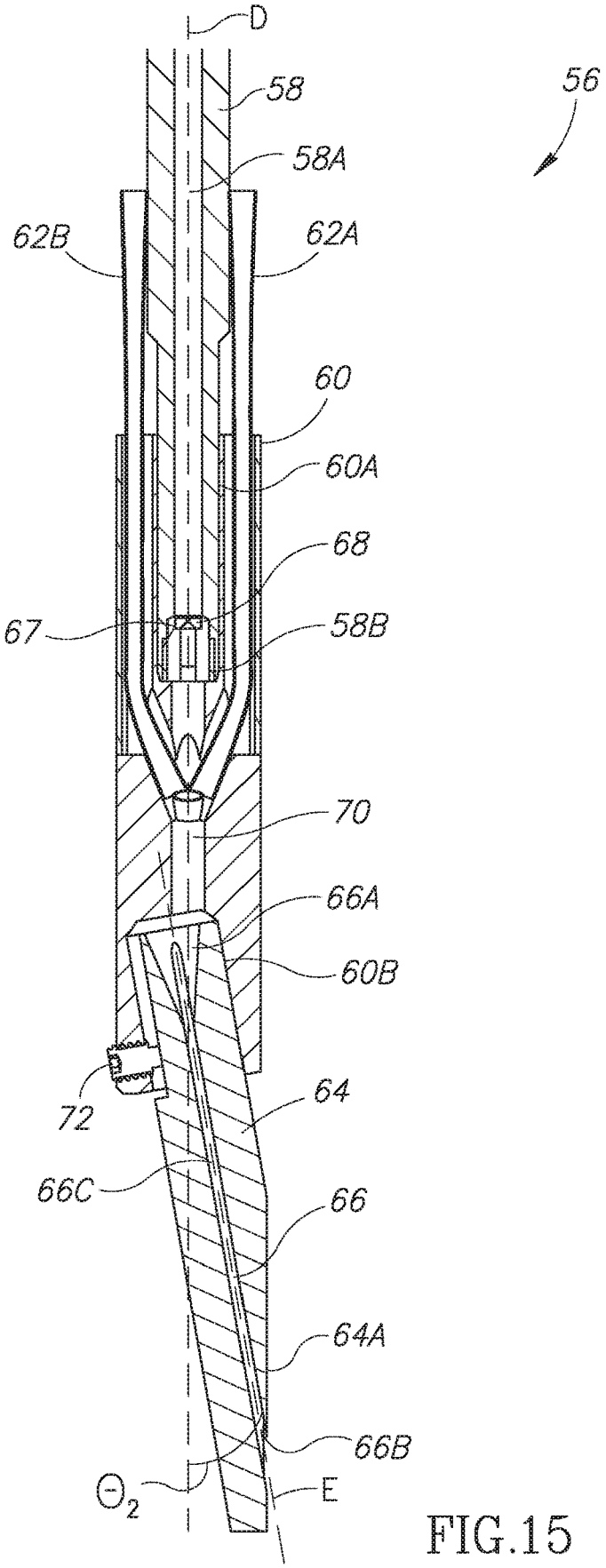
FIG. 15 illustrates a cross-sectional left side view of the abrasive jet apparatus of FIG. 14.
Figure 16:
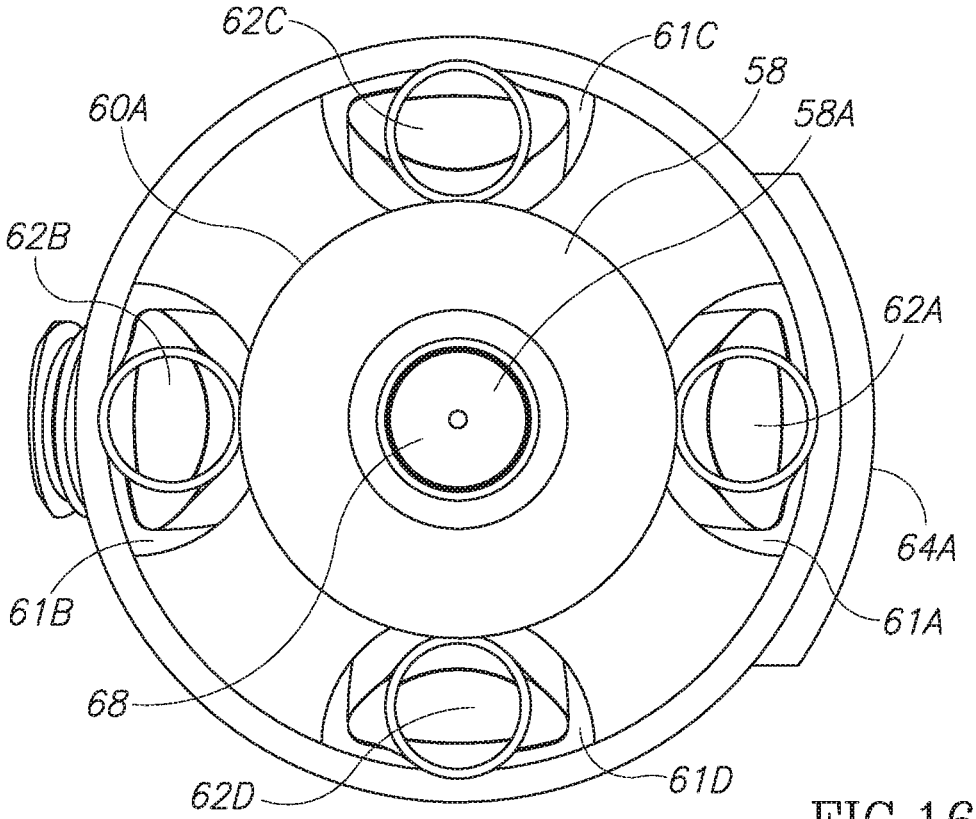
FIG. 16 illustrates an enlarged top view of the abrasive jet apparatus of FIG. 13.
Figure 17:
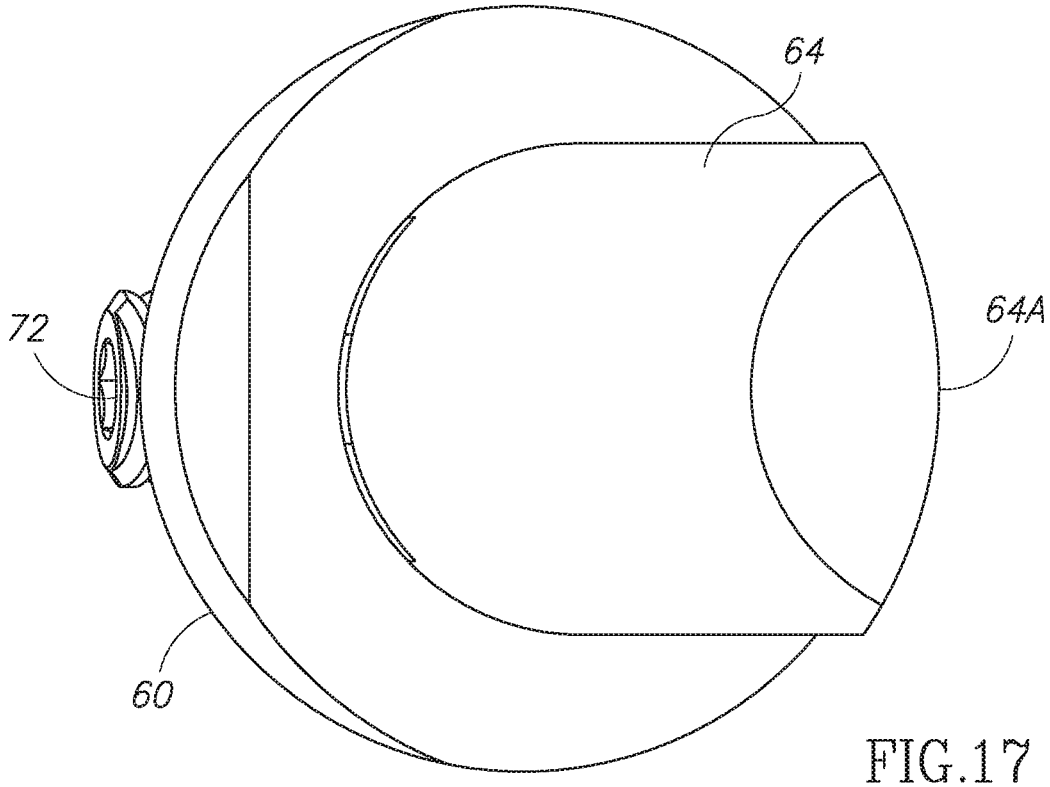
FIG. 17 illustrates an enlarged first bottom side view of the abrasive jet apparatus of FIG. 13.

The liquid inlet tube 58 has an inner conduit portion 58A, as shown in FIG. 15, through which a pressurized liquid may flow. The liquid inlet tube 58 extends into and is fixed within a cavity 60A of the abrasive jet main body 60. The abrasive particle inlets/outlets 62A-62D extend into four corresponding cavities shown in FIG. 16. A cavity 67 is disposed between the inner conduit portion 58A and a mixing chamber 70. The cavity 67 acts similarly to seal 27 of abrasive jet apparatus 10. The cavity 67 envelops an orifice 68 centered along axis D. The cavity 67 and the orifice 68 are substantially identical to seal 27 and orifice 28 otherwise, so further description of the cavity 67 and the orifice 68 is omitted for the sake of brevity. A pressurized liquid is injected into the inner conduit portion 58A and travels in a direction along axis D into the orifice 68. The liquid is propelled through the orifice 68 and exits therefrom as a high-velocity liquid jet into the mixing chamber 70.

Figure 18:
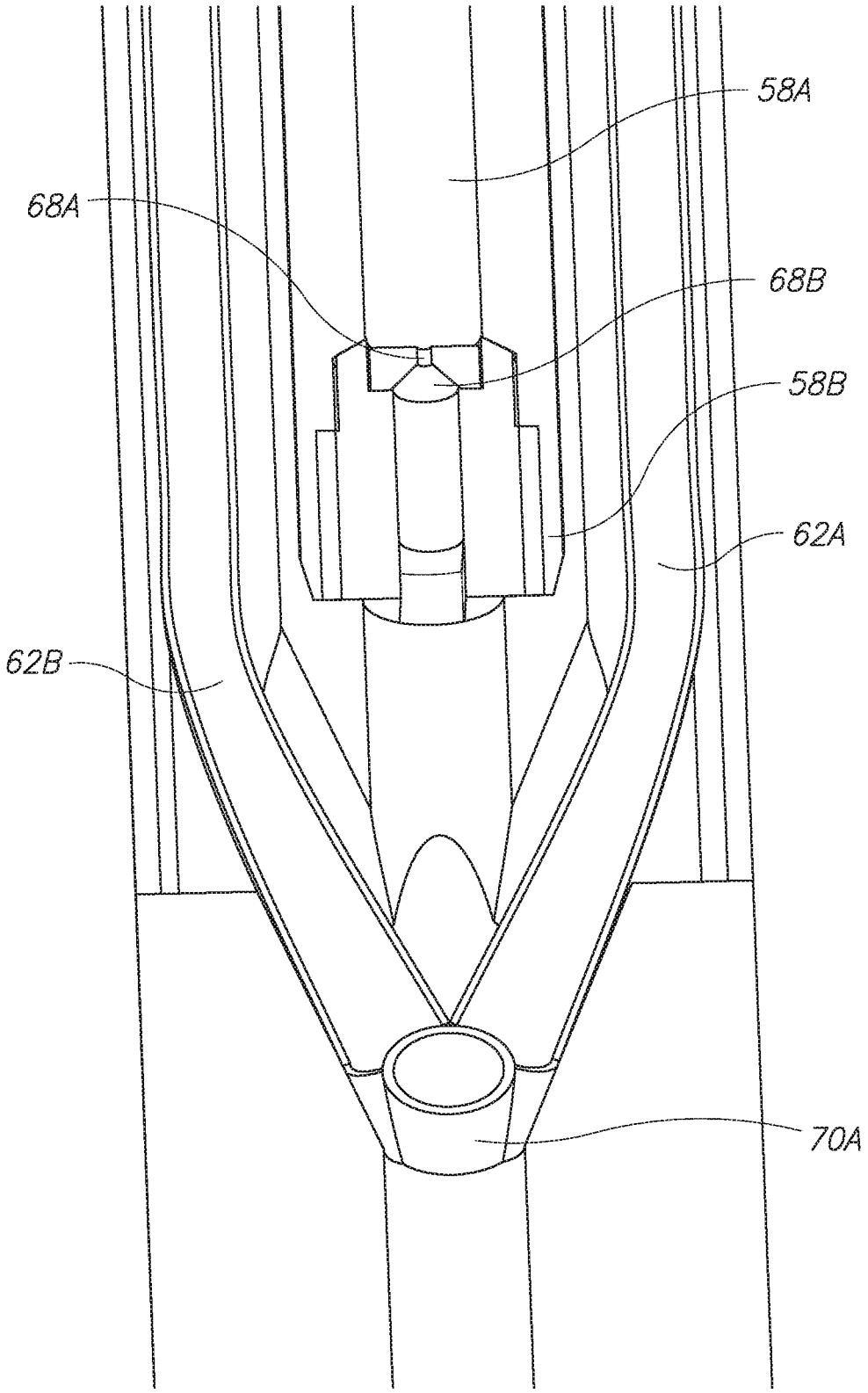
FIG. 18 illustrates an enlarged cross-sectional left side view of an abrasive jet main body of the abrasive jet apparatus of FIG. 13.

The abrasive particle inlets/outlets 62A-62D extend beyond the liquid tube distal end 58B of the liquid inlet tube 58 and bend in an inward direction toward the mixing chamber 70, as seen in FIGS. 15 and 18. A portion of the ends of the abrasive particle inlets/outlets 62A-62D may be machined away to allow the high-velocity liquid jet to pass unimpeded from the orifice 68 into the mixing chamber 70. One or more of the abrasive particle inlets/outlets 62A-62D may be an abrasive particle inlet. For example, the abrasive particle inlet/outlet 62A may be abrasive particle inlet 62A. One or more of the abrasive particle inlets/outlets 62B-62D may also be an abrasive particle inlet tube. A larger volume or varied distribution of abrasive particles may be introduced to the high-velocity liquid jet by using more than one abrasive inlet than when just a single abrasive jet inlet is used.

Abrasive particles are supplied to the abrasive particle inlet 62A. The high-velocity liquid jet entrains abrasive particles through the abrasive particle inlet tube 62A and into a mixing chamber upper end 70A, as seen in FIG. 18. The Venturi effect draws abrasive particles from the abrasive particle inlet 62A into the mixing chamber 70. The abrasive particles and the liquid jet are mixed into an abrasive mixture in the mixing chamber 70. In the mixing chamber 70, the abrasive particles are accelerated by the liquid jet. The abrasive mixture travels in a linear direction from the mixing chamber 70 into the nozzle conduit 66.

As previously discussed, great care is taken in conventional waterjet machining to align the orifice with the nozzle. However, in the abrasive jet apparatus 56, the nozzle conduit 66 extends along axis E at an angle $\theta_2$ with respect to axis D. The angle $\theta_2$ may be in the range $0° < \theta \leq 60°$. For ease of assembly, the nozzle portion 64 in FIG. 15 is inserted into the cavity 60B of the abrasive jet main body 60 and set into place using a set screw 72. Alternatively, the abrasive jet main body 60 and nozzle portion 64 may be a monolithically formed structure.

Figure 19:
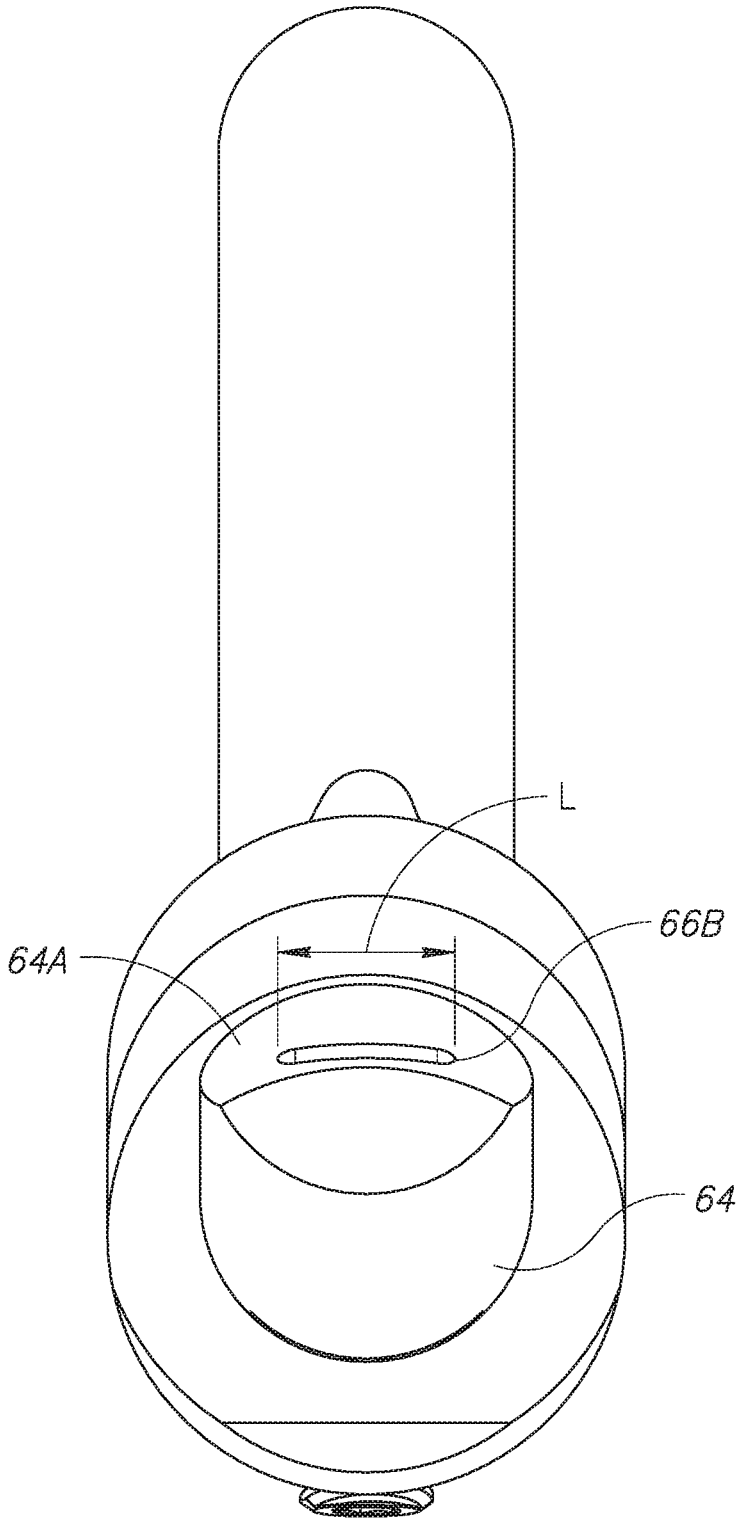
FIG. 19 illustrates an enlarged second bottom side view of a nozzle of the abrasive jet apparatus of FIG. 13.
Figure 20:
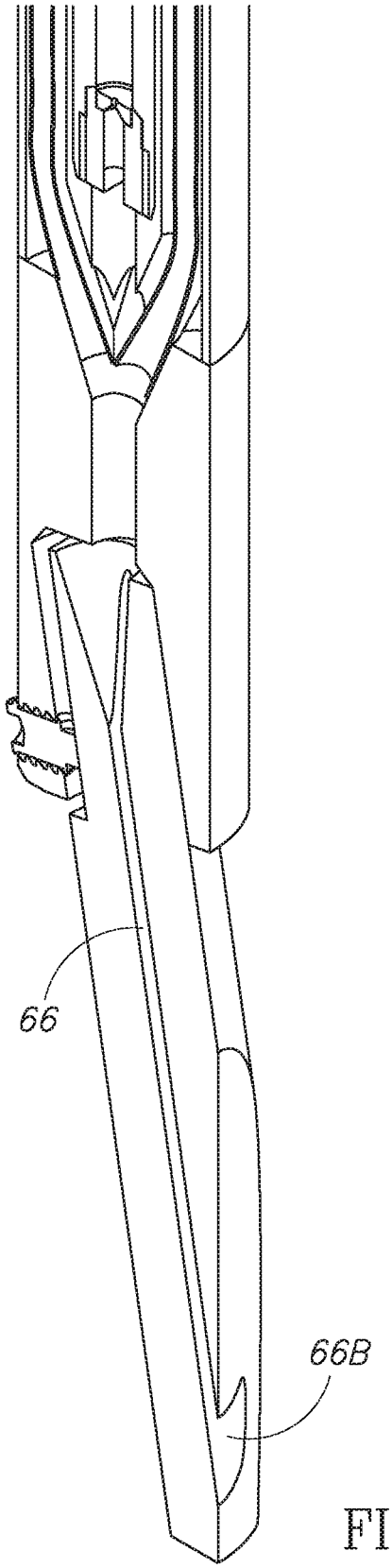
FIG. 20 illustrates an enlarged cross-sectional left side view of the nozzle of the abrasive jet apparatus of FIG. 13.

The abrasive mixture enters the nozzle conduit 66 where the abrasive particles are accelerated to form an abrasive jet. In particular, the abrasive mixture is linearly directed into a converging conical nozzle cavity 66A. The abrasive mixture strikes the wall 66C of the nozzle conduit 66, causing the abrasive particles to spread into a fan shape. The nozzle conduit 66 has an oblong slot shape with rounded lateral sides, as seen in FIGS. 19 and 20. The nozzle conduit 66 may instead have a round or rectangular shape. The abrasive particles in the abrasive mixture are accelerated along the length of the nozzle conduit 66 to form the abrasive jet. The abrasive jet is propelled from a nozzle aperture 66B of the nozzle conduit 66 along axis E toward a target surface of a bored structure. Because of the oblong slot shape of the nozzle conduit, the abrasive jet has a fan shape. The fan-shaped abrasive jet creates a recess of a controlled width and a controlled depth in the target surface of the bored structure.

One or more of the abrasive particle inlets/outlets 62B-62D may optionally be an abrasive particle outlet. As previously described with respect to abrasive jet apparatus 10, a vacuum or other similar device may be connected to the abrasive particle outlet(s) to create a low or negative pressure at the abrasive particle outlet(s). The low or negative pressure promotes a uniform introduction of abrasive particles into the high-velocity liquid jet and improves the overall flow of the abrasive jet by removing excess abrasive particles and air from the mixing chamber 70.

Although abrasive jet apparatus 56 has four abrasive particle tubes 62A-62D, abrasive jet apparatus 56 may have a different number of abrasive particle inlets/outlets. The abrasive jet apparatus 56 may instead have only one abrasive particle inlet 62A. The abrasive jet apparatus 56 alternatively may only have a single abrasive particle inlet 62A and a single abrasive particle outlet 62B, by way of non-limiting example. The abrasive jet apparatus 56 instead may have more than four abrasive particle inlets/outlets.

To enhance the accuracy, longevity, and/or speed of machining, one or more of the following four variations may be implemented in the first to third embodiments. As a first variation, the orifice of the abrasive jet apparatus may have multiple apertures for passing pressurized fluid. The multiple apertures may be arranged to match the cross-sectional dimensions of a slotted or oblong nozzle conduit. By way of non-limiting example, the orifice 46 may have two or more cylindrical upper sections 46A (apertures). A corresponding conical lower section 46B (aperture) is also provided for each of the two or more cylindrical upper sections 46A. The two or more cylindrical upper sections 46A and corresponding conical lower section 46B may be arranged in a row along the length direction L of the nozzle conduit 40. The orifice conduit 47 of abrasive jet apparatus 32 may have a slotted or oblong shape similar to or matching the slotted or oblong shape of the nozzle conduit 40. A liquid jet is propelled from each of the orifices 46, through the orifice conduit 47, and into the mixing chamber 48. One of the orifices 46 may be aligned with the axis C while the other orifices 46 are offset from the axis C. Alternatively, all of the orifices 46 may be offset from the axis C.

The liquid jets entrain abrasive particles from the abrasive particle inlet 44 into the mixing chamber 48. The liquid jets and abrasive particles are propelled into and accelerated in the nozzle conduit 40. A larger volume of abrasive particles are propelled into the nozzle conduit 40 using more than one liquid jet than when only a single liquid jet is introduced. The two or more jets of abrasive mixture strike the wall portion 40C causing the liquid jets and abrasive particles to spread out into a fan shape. The abrasive mixture is accelerated through the nozzle conduit 40 to form an abrasive jet. The abrasive jet is propelled from the nozzle aperture 40B toward the target surface in a fan shape. The abrasive jet produced by the multiple orifices 46 removes more material from the target surface than the abrasive jet produced by a single orifice 46.

The configuration of the two or more orifices 46 may be adjusted according to the shape and size of the nozzle conduit 40. By way of non-limiting example, if the abrasive jet apparatus 32 has a round nozzle conduit 40, several orifices 46 may be arranged around a central orifice 46 to increase the efficiency of the abrasive jet. As another non-limiting example, if the nozzle conduit 40 is rectangular and has a greater width than the slotted nozzle conduit 40 illustrated in FIG. 12, additional rows of orifices 46 may be employed to utilize the additional cross-sectional area of the rectangular nozzle conduit 40. The abrasive jet apparatus 10 and/or the abrasive jet apparatus 56 may be modified in a manner similar to the abrasive jet apparatus 32 to include two or more orifices.

As a second variation, the shape and size of the orifice may be adjusted to match the shape of a nozzle conduit that has a non-round shape. For example, in abrasive jet apparatus 32, the orifice 46 may have a slotted shape corresponding to the shape of the nozzle conduit 40. The orifice 46 may have a small slot-shaped upper portion 46A and a larger slot-shaped lower portion 46B. The slot-shaped orifice 46 would produce a liquid jet having a flat and elongated shape in the direction L of the nozzle conduit 40.

As a third variation, a plurality of abrasive particle inlets and/or a plurality of abrasive particle outlets may be disposed on sidewalls of the mixing chamber to distribute the abrasives more evenly within the mixing chamber and the nozzle conduit. For example, in the abrasive jet apparatus 10, several abrasive particle inlets 18A and/or abrasive particle outlets 18B may be disposed along the sidewalls of mixing chamber 30. The abrasive jet apparatus 32 may be modified in a similar manner to include a plurality of abrasive particle inlets and/or a plurality of abrasive particle outlets which may be disposed on sidewalls of the mixing chamber 48.

As a fourth variation, the nozzle portion, including walls of the nozzle conduit, may be formed of a ceramic composite mixing tube to enable the use of hard abrasive particles. Softer abrasive particles may be effective on refractory metals such as tantalum-tungsten alloys, but are ineffective on ceramic or ceramic composite. By way of non-limiting example, softer abrasive particles may comprise garnet, glass or olivine particles; whereas harder abrasive particles may comprise silicon carbide, alumina or boron carbide. A nozzle portion made of a ceramic composite may withstand impact from harder abrasive particles that would ablate a nozzle portion made of a softer material.

In a further modification, a premixed fluid comprising abrasive particles and liquid may be injected into an abrasive jet apparatus. In the above-described abrasive jet apparatuses, abrasive particles and pressurized liquid are separately introduced into and combined within the abrasive jet apparatus. When using the premixed fluid, the abrasive inlets and outlets and mixing chambers of each of the abrasive jet apparatuses may be omitted. The premixed fluid is injected into the liquid inlet conduit, accelerated through a hard and wear resistant orifice, and an abrasive jet is propelled from the nozzle portion. For example, in abrasive jet apparatus 10, the particle inlet tube 24, particle outlet tube 26 and mixing chamber 30 may be omitted when using the premixed fluid. The pressurized premixed fluid could be injected into the liquid tube inner conduit 22A of the liquid inlet tube 22. The premixed fluid would accelerate through the orifice 28 and out of the nozzle conduit 20. The abrasive jet apparatus 32 and abrasive jet apparatus 56 may be similarly modified to simplify and miniaturize the overall structure.

Figure 21:
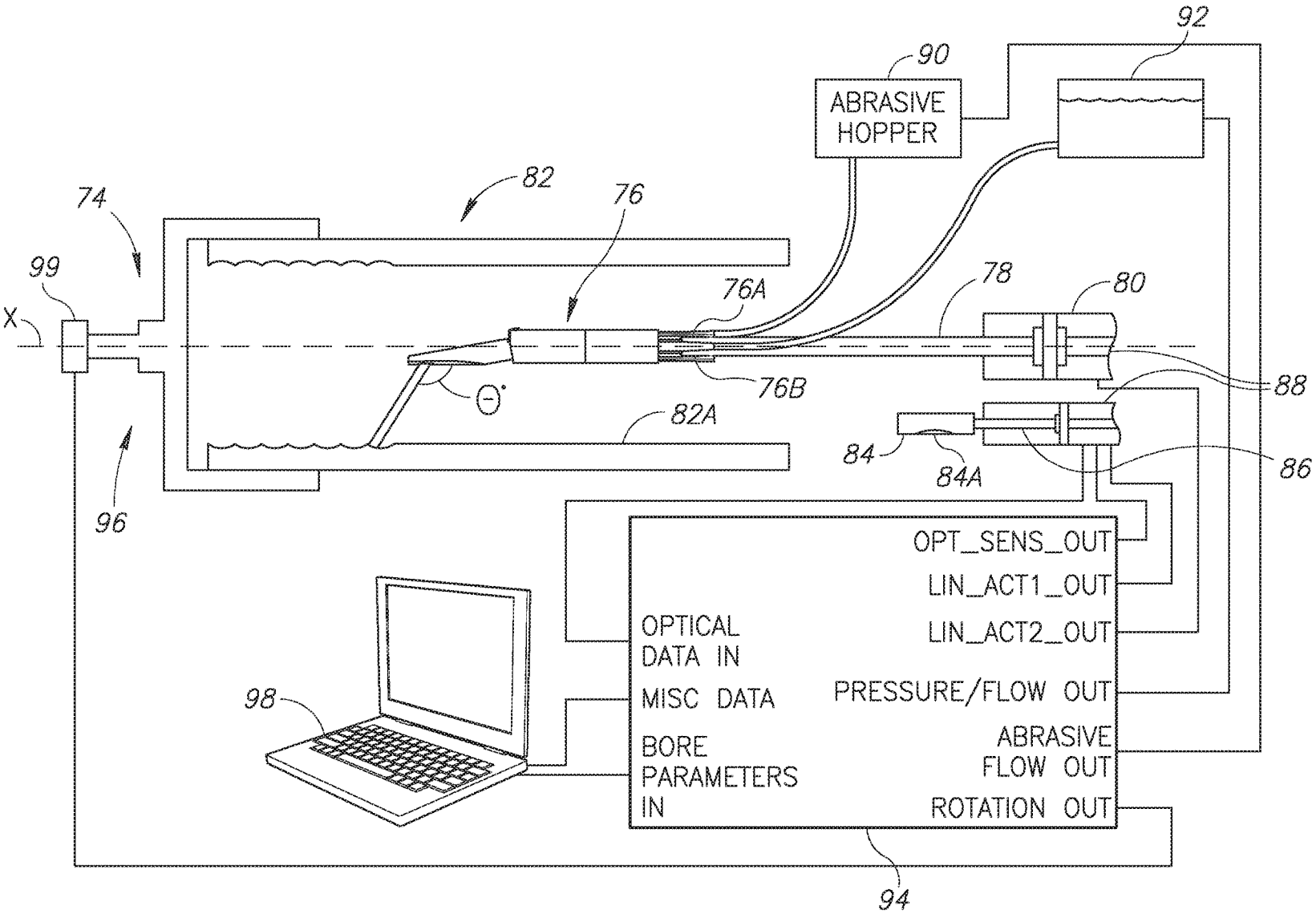
FIG. 21 illustrates a schematic view of a boring system that uses an abrasive jet apparatus.

An automated boring system 74 for machining rifling features into and changing bore diameters of bored structures is shown in FIG. 21. An abrasive jet apparatus 76 is disposed on an end of a rigid bar 78. The abrasive jet apparatus 76 may be one of the abrasive jet apparatuses described above, including any of the modifications or variations thereof. A first actuator 80 moves the rigid bar 78 back and forth along a first direction that is parallel to the central axis X of a bored structure 82. A non-contact sensor 84 is also provided which may detect the distance between a measurement element 84A and a target surface without contacting the target surface. By way of non-exhaustive list, the non-contact sensor 84 may be an optical sensor, a laser sensor, an ultra-sound sensor, or other sensor that may detect the distance to a surface in a non-contact manner. The non-contact sensor 84 is disposed on an end of a rigid bar 86. A second actuator 88 moves the non-contact sensor 84 back and forth along the first direction.

The boring system 74 has a controller 94. The controller 94 may receive measurement data from the non-contact sensor 84 that indicates the distance between the measurement element 84A and the target surface 82A. From the non-contact sensor 84 and/or second actuator 88, the controller 94 may receive axial position data indicating the axial position of the non-contact sensor 84 along central axis X, and radial position data indicating a radial position of the non-contact sensor 84 about the central axis X. The controller 94 receives data indicating a desired bore profile of a target bored structure 82 from an input device 98. The controller 94 may also receive other miscellaneous data from the input device 98. The miscellaneous data may include the material and/or hardness of the target surface 82A of the bored structure 82, the size of the abrasive particles in an abrasive hopper 90, and/or the hardness of the abrasive particles in the abrasive hopper 90. The controller 94 is configured to send control signals to each of first actuator 80, second actuator 88, abrasive hopper 90, liquid pump 92, non-contact sensor 84, and a motor 99 of a rotation means 96.

The controller 94 has a processing unit and a data storage unit. The data storage unit may include both RAM and ROM memory, and may further include a removable data storage device, such as an optical disc or a USB memory stick. The controller 94 may be a general-use microprocessor configured to execute a set of instructions stored in the data storage unit. The processing unit may be a special use processor, such as an FPGA or ASIC, specifically configured to control the boring system 74 as described herein.

The input device 98 may be a computer programmed to allow a user to create a model of the desired bore profile. The input device 98 may be a standard input interface such as a USB port, optical disc reader, wireless transceiver, keyboard, mouse and/or touchscreen. The input device 98 and/or controller 94 may be separate devices, or may be parts of a larger integrated device, such as a CNC machine. The controller 94 may be programmed to receive a predetermined file type from the input device 98 indicating the desired bore profile.

The controller 94 may control the boring system 74 to move the first actuator 80 and the second actuator 88 so that the second actuator 88 is centered along the central axis X instead of the first actuator 80. The controller 94 sends a second actuator control signal to the second actuator 88. The second actuator control signal controls the second actuator 88 to move the non-contact sensor 84 and the rigid bar 86 in a direction along or parallel to the central axis X. The second actuator control signal also controls the second actuator 88 to rotate the non-contact sensor 84 and the rigid bar 86 in a radially around the central axis X or an axis parallel to the central axis X. Alternative to rotating the non-contact sensor 84 and the rigid bar 86 radially, the controller 94 may rotate the bored structure 82 radially by sending a signal to motor 99 of a rotation means 96, while fixing the rotational position of the non-contact sensor 84 and rigid bar 86. All further references to rotation of the sensor 84 may be alternatively applied as rotation of the bored structure 82. The controller 94 controls the second actuator to extend the non-contact sensor 84 into the bored structure 82 to measure distance to the target surface 82A.

The abrasive hopper 90 is connected to an abrasive particle inlet port 76A of the abrasive jet apparatus 76. The abrasive hopper 90 has a valve (not shown) that controls the flow of abrasive particles from the abrasive hopper. Controller 94 sends a hopper control signal to the abrasive hopper 90. The hopper control signal controls the valve of the abrasive hopper 90 to adjust the flow of abrasive particles to the abrasive particle inlet port 76A The liquid pump 92 is connected to a liquid input port 76B of the abrasive jet apparatus 76. The liquid pump 92 pressurizes liquid to a pressure between 10,000 PSI and 120,000 PSI. The liquid pump 92 also has a valve which controls the flow of pressurized liquid from the liquid pump 92. The controller 94 also sends a liquid pump control signal to the liquid pump 92. The liquid pump control signal controls the valve of the liquid pump 92 to adjust the flow of pressurized liquid to the liquid input port 76B, and controls the liquid pump 92 to pressurize the of liquid to a pressure between 10,000 PSI and 120,000 PSI.

The rotation means 96 rotates the bored structure 82 about the central axis X. The rotation means 96 may rotate the bored structure 82 in conjunction with operation of the abrasive jet apparatus 76 to remove material from the target surface 82A of the bored structure. The rotation means 96 may be any rotary device capable of securing and rotating a bored structure 82, such as a lathe. The rotation means 96 may be a stand-alone device or may be part of a larger integrated apparatus, such as a computer numerical control (CNC) machine. Alternatively, the rotation means 96 may instead be configured to rotate the abrasive jet apparatus 76 relative to the bored structure 82. The controller 94 sends a rotation control signal to motor 99 of the rotation means 96. The rotation control signal controls a direction and rate of rotation of the motor 99.

Figure 22:
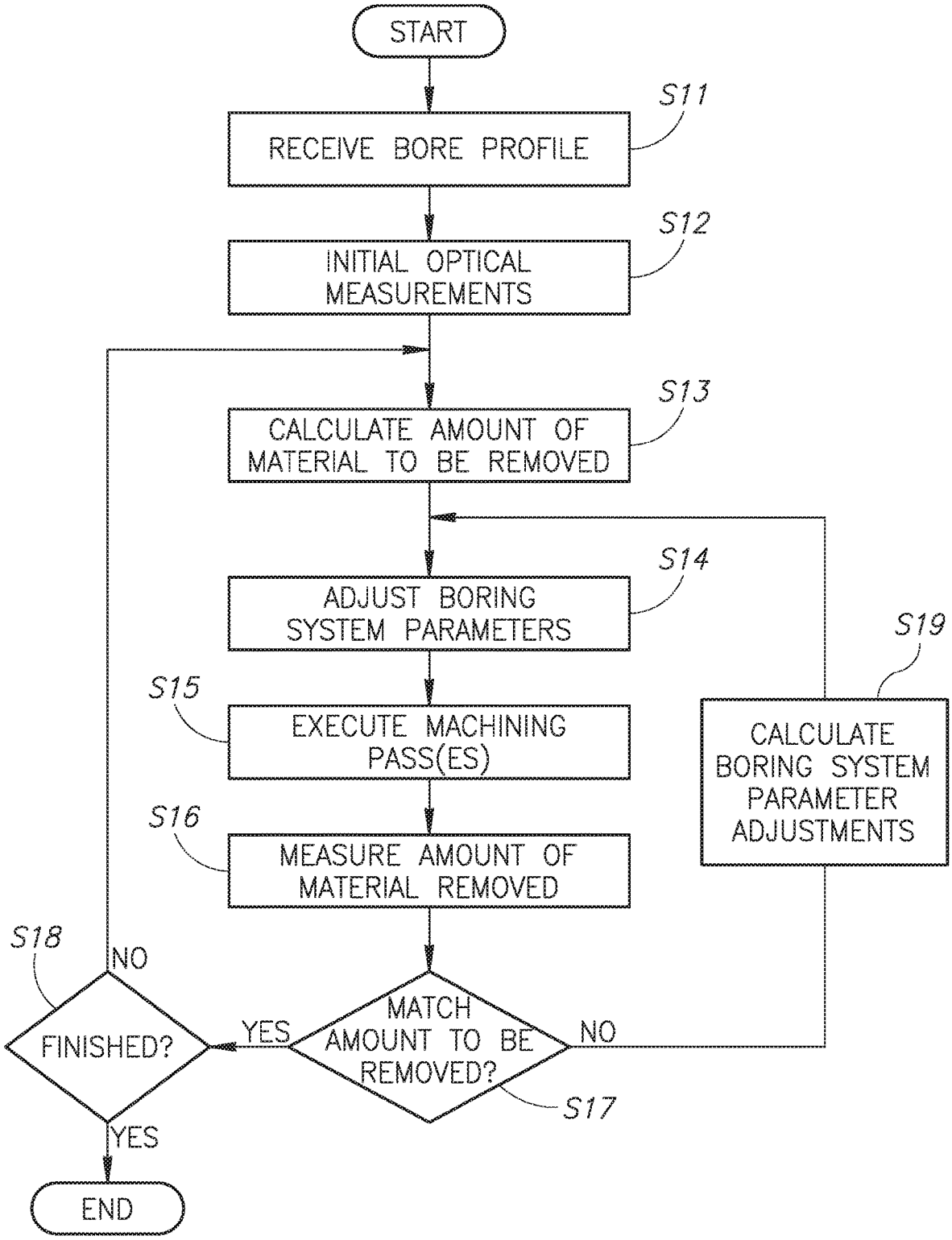
FIG. 22 illustrates a method of controlling the boring system of FIG. 21.

Before the machining process begins, the controller 94 receives input data from an input device 98 indicating a desired bore profile of the bored structure 82 and other miscellaneous data, as seen in step S11 of FIG. 22. The desired bore profile specifies several characteristics that the automated boring system 74 should impart on the bored structure 82, including any of the following:

(i) number of grooves;
(ii) width and depth of each of the grooves;
(iii) shape of each of the grooves;
(iv) pitch angle of the grooves;
(v) information indicating variable or constant groove geometry, such as varying width, depth, shape, and/or pitch angle of the grooves; and
(vi) desired inner diameter of the bored structure.

Before beginning to remove material from the bored structure 82, the controller 94 may acquire an initial bore profile of the bored structure 82, as shown in step S12 of FIG. 22. In step S12, the boring system 74 centers the second actuator 88 and non-contact sensor 84 along the central axis X of the bored structure 82. The second actuator 88 moves and rotates the non-contact sensor 84 within the bored structure 82 while the measurement element 84A measures the distance to the target surface 82A. The controller 94 receives the measurements from the measurement element 84A in conjunction with the axial position data and radial position data create an initial contour map of the target surface 82A.

In step S13, the controller 94 calculates how much material to remove from each location on the target surface 82A. Specifically, in step S13, the controller 94 calculates a path for the abrasive jet to traverse on the target surface 82A to remove material according to the desired bore profile. The controller 94 also calculates how much material to remove at each location along the path of the target surface 82A based on a comparison between the desired bore profile of S11 and the initial contour map generated in step S12. The boring system 74 may perform several passes of the abrasive jet apparatus 76 over the target surface 82A to achieve the desired bore profile. The initial passes of the abrasive jet apparatus 76 may typically remove more material than subsequent passes. In particular, the controller 94 may calculate a larger amount of material to remove in an initial pass and gradually reduce the amount of material to remove in subsequent passes. Final passes may impart a particular finish to the target surface 82A. This iterative process results in great depth control so that tight tolerances of ±0.001 inches may be achieved. Alternatively, the controller may remove the entire calculated amount of material in a single pass.

In step S14, the controller 94 may adjust the parameters of the boring system 74 to remove an amount of material from each location of the target surface 82A. The controller 94 may control the following parameters in concert to achieve the desired amount of material removal: (i) position of the abrasive jet apparatus 76 along the central axis X using the first actuator 80, including the rate of movement of the abrasive jet apparatus 76 within the bored structure 82; (ii) the abrasive particle flow rate to the abrasive particle inlet port 76A, (iii) the pressure of the pressurized liquid in the liquid pump 92, (iv) the flow rate of pressurized liquid to the liquid input port 76B; and (v) the rate and direction of rotation of the motor 99. If the abrasive jet apparatus 76 is configured to have an abrasive particle outlet port (not shown), the controller 94 may control a vacuum or other similar device to control a flow rate of abrasive particles from the abrasive jet apparatus 76. The controller 94 may adjust the rate of movement of the abrasive jet apparatus 76 along the central axis X and the rate of rotation of the motor 99 to overlap a successive pass of the abrasive jet with a preceding pass of the abrasive jet. As a relevant factor to the amount of material a given pass may remove, controller 94 may consider the hardness and/or type of material of the bored structure 82. The controller 94 may also consider the hardness and/or size of the abrasive particles in the abrasive hopper 90 as a relevant factor to removal of material from the target surface 82A.

The controller 94 may calculate other parameters in step S14. For example, when the desired bore profile is that of a rifled barrel, the controller 94 may calculate the rate of rotation of the motor 99 and the rate of movement of the first actuator 80 to match the desired pitch angle of the grooves. If the desired bore profile of a rifled barrel indicates a varying geometry, the controller 94 may calculate the rate of change of a corresponding output parameter to achieve the varying geometry. For example, if the desired bore profile of a gun barrel has a varying pitch angle, the controller 94 may calculate a rate of change of the rotation rate of the rotation means 96 to achieve the desired varying pitch angle. As a further non-limiting example, if the desired bore profile of a gun barrel has a varying depth along a length of the grooves, the controller 94 may calculate the rate of change of the liquid pressure, the liquid flow rate, and/or the abrasive particle flow rate to achieve the varying depth.

In step S15, the boring system 74 executes a pass of the abrasive jet over the target surface 82A of the bored structure 82. In particular, the controller 94 controls the first actuator 80 to position the abrasive jet apparatus 76 at a first end of the bored structure 82. The controller 94 then controls the pressure of the liquid in the liquid pump 92, the flow rate of the pressurized liquid to the liquid input port 76A, and the flow rate of abrasive particles from the abrasive hopper 90 to the abrasive particle inlet port 76A to direct an abrasive jet against the target surface 82A. If the abrasive jet apparatus 76 has an abrasive particle outlet port (not shown), the controller 94 may control a vacuum or other similar device to control the flow rate of abrasive particles from the abrasive jet apparatus 76. Concurrently, the controller 94 controls the rate and direction of rotation of the motor 99. Using the first actuator 80, the controller 94 also concurrently controls the rate of movement of the abrasive jet apparatus 76 along, or parallel to, the central axis X. The controller 94 may adjust the rate of change of any of the above parameters according to the parameters calculated in step S14 during the initial pass. Once the abrasive jet has traversed an entire length of the bored structure 82, the controller 94 temporarily terminates operation of the abrasive hopper 90, the liquid pump 92, the rotation means 96, and the first actuator 80.

In step S16, the boring system 74 measures the amount of material actually removed from the bored structure 82 in the preceding pass. Specifically, the controller 94 controls the second actuator 88 such that the non-contact sensor 84 measures the groove or bore dimension that the abrasive jet created in the preceding pass. The non-contact sensor 84 is moved axially along and rotated radially about the central axis X within the bored structure 82 to map the target surface 82A. While moving over the target surface 82A, the measurement element 84A measures the distance to the target surface 82A in a non-contact manner. The controller 94 receives information including distance measurements from the non-contact sensor 84. For each distance measurement, the controller 94 also receives axial and rotary position data of the non-contact sensor 84. The controller 94 uses the measurement and position information to create a three-dimensional contour map of the target surface 82A and any groove that the abrasive jet creates therein. The controller 94 may additionally control the non-contact sensor 84 to monitor local areas of the target surface 82A that require further machining.

In step S17, the controller 94 determines whether the target surface 82A matches the desired bore profile based on the contour map generated in step S16. If the controller 94 determines that the target surface 82A does not match the desired bore profile, the controller 94 calculates how to adjust the boring system parameters in step S19. In step S19, the controller 94 compares the contour map generated in step S16 with a previously generated contour map to determine how to adjust the boring system parameters. If the current pass is an initial pass, the previously generated contour may be the initial contour map generated in step S12. If the current pass is not the initial pass, the previously generated contour map may be one or more of the contour maps generated in a preceding step S16 and/or the initial contour map generated in step S12. The controller 94 may track the efficacy of each pass to more efficiently adjust boring system parameters for subsequent grooves.

Returning to step S14, the controller 94 adjusts the parameters of the boring system 74 for each location of the target surface 82A according to the adjustments determined in step S19. Steps S15-S17 are additionally repeated until the current groove or target surface 82A matches the desired bore profile.

In step S17, if the controller determines that the target surface 82A sufficiently matches the desired bore profile to within the required tolerance range, the controller 94 moves on to step S18. In step S18, the controller 94 determines whether additional grooves and/or bore features should be machined. If additional grooves and/or bore features should be machined, the controller returns to step S13 to calculate the amount of material to be removed to create the next groove and/or bore feature. The grooves and/or bore features are successively machined around the inner diameter of the bored structure 82 until the target surface 82A matches the desired bore profile to the required tolerance.

As a first variation, the boring system 74 may be equipped with a plurality of abrasive hoppers 90 each containing abrasive particles of different size and hardness. When the boring system 74 is equipped with a plurality of abrasive hoppers 90, the controller 94 may be configured to control the removal rate of material from the target surface 82A by changing the size or hardness of the abrasive particles applied to the target surface 82A. That is, the boring system 74 may select which abrasive hopper 90 feeds the abrasive jet apparatus 76 to change the rate of material removal form the target surface 82A. In the initial pass, the boring system 74 could select an abrasive hopper 90 containing a harder or larger size abrasive particle to remove more material. In a subsequent pass, the boring system 74 could then select an abrasive hopper 90 containing a softer or smaller size abrasive particle to fine tune the characteristics of the groove to a tight tolerance, or to provide a finish on the target surface 82A. The controller 94 could also receive data via the miscellaneous data input indicating the number of hoppers attached and the characteristics of the abrasive particles contained in each of the abrasive hoppers.

As a second variation, the automated boring system 74 may have more than one abrasive nozzle apparatuses 76. The abrasive nozzle apparatuses 76 may be radially offset from each other at a fixed angle around the central axis X. The boring system 74 may simultaneously machine multiple grooves using more than one abrasive nozzle apparatuses 76 to increase the efficiency and production speed of the boring system 74.

The abrasive jet apparatuses 10, 32, 56 and automated boring system 74, including any variations described herein, may be used to machine grooves and/or bore features into the interior of bored structures made of steel, refractory metal and ceramic. The abrasive jet apparatuses 10, 32, 56 and automated boring system 74, including any variations described herein, may also be used to change the diameter of existing bores in bored structures. According to one embodiment, the abrasive jet apparatuses 10, 32, 56 may fit into and machine bores or grooves into a bored structure having an inner diameter of 5 mm to 9 mm. In another embodiment, the abrasive jet apparatuses 10, 32, 56 may fit into and machine bores or grooves into bored structures having an inner diameter of 5 mm to 12.7 mm, or 12.7 mm to 25 mm. The abrasive jet apparatuses 10, 32, 56 are not exclusive to a single caliber range and can machine bores, grooves and/or bore features into large diameter bored structures, such as those used on naval vessel cannons having an inner diameter of 155 mm, by way of non-limiting example. All variations of the abrasive jet apparatuses 10, 32, 56 and the automated boring system 74 described herein may fit into and machine bores having an inner diameter in a range of 5 mm to 155 mm, inclusive. The automated boring system 74 may machine bores or grooves inside a bored structure in multiple passes. The automated boring system 74 may also machine a wide groove into a bored structure in a single pass.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare statement of "two recitations," without other modifiers, typically means at least two recitations, or two or more recitations).

What is claimed is:

1. A method of changing a bore profile of a bore of a bored structure, comprising:

receiving first data indicating an initial bore profile of the bored structure and second data from an input device indicating a desired bore profile of the bored structure;

rotating one of an abrasive jet apparatus and the bored structure about an axis of rotation relative to an other of the abrasive jet apparatus and the bored structure;

positioning the abrasive jet apparatus within the bore of the bored structure; and responsive to the first data and the second data:

(i) moving the abrasive jet apparatus along a first direction within the bore of the bored structure, wherein the first direction is a direction along or parallel to a central axis of the bore, (ii) controlling a rate of rotation of the one of the abrasive jet apparatus and the bored structure, (iii) directing an abrasive mixture as an abrasive jet from a nozzle portion of the abrasive jet apparatus in a second direction different than the first direction, the abrasive jet forming a recess on a target surface of the bore of the bored structure, and the abrasive mixture is a mixture of a pressurized liquid and abrasive particles, (iv) measuring dimensions of the recess formed on the target surface using a non-contact sensor, (v) determining whether the measured dimensions of the recess are acceptable based on the desired bore profile of the bored structure, and (vi) if the measured dimensions of the recess are determined to be not acceptable based on the desired bore profile of the bored structure, repeating steps (i)-(iii) to adjust one or more dimensions of the recess on the target surface.

2. The method of claim 1, wherein steps (i)-(vi) are repeated until the measured dimensions of the recess correspond to the desired bore profile.

3. The method of claim 1, wherein the pressurized liquid is pressurized to a pressure between 10,000 pounds per square inch and 120,000 pounds per square inch, inclusive.

4. The method of claim 1, wherein the second data from the input device represents a rifling profile.

5. The method of claim 1, wherein the second data from the input device represents the initial bore profile with at least one changed bore dimension.

6. The method of claim 5, wherein the second data from the input device represents the initial bore profile with the at least one changed bore dimension being a changed bore diameter.

7. A method of changing a bore profile of a bore of a bored structure, comprising:

receiving first data indicating an initial bore profile of the bored structure and second data from an input device indicating a desired bore profile of the bored structure;

rotating one of an abrasive jet apparatus and the bored structure about an axis of rotation relative to an other of the abrasive jet apparatus and the bored structure;

positioning the abrasive jet apparatus within the bore of the bored structure; and responsive to the second data:

(i) moving the abrasive jet apparatus along a first direction within the bore of the bored structure, wherein the first direction is a direction along or parallel to a central axis of the bore, (ii) controlling a rate of rotation of the one of the abrasive jet apparatus and the bored structure, (iii) directing an abrasive mixture as an abrasive jet from a nozzle portion of the abrasive jet apparatus in a second direction different than the first direction, the abrasive jet forming a recess on a target surface of the bore of the bored structure, and the abrasive mixture is a mixture of a pressurized liquid and abrasive particles, (iv) measuring dimensions of the recess formed on the target surface using a non-contact sensor, (v) determining whether the measured dimensions of the recess are acceptable based on the desired bore profile of the bored structure, and (vi) if the measured dimensions of the recess are determined to be not acceptable based on the desired bore profile of the bored structure, repeating steps (i)-(iii) to adjust one or more dimensions of the recess on the target surface.

8. The method of claim 7, wherein steps (i)-(vi) are repeated until the measured dimensions of the recess correspond to the desired bore profile.

9. The method of claim 7, wherein the pressurized liquid is pressurized to a pressure between 10,000 pounds per square inch and 120,000 pounds per square inch, inclusive.

10. The method of claim 7, wherein the second data from the input device represents a rifling profile.

11. The method of claim 7, wherein the second data from the input device represents the initial bore profile with at least one changed bore dimension.

12. The method of claim 11, wherein the second data from the input device represents the initial bore profile with the at least one changed bore dimension being a changed bore diameter.

* * * * *